US009764589B2

(12) United States Patent
Hilton Dunne

(10) Patent No.: US 9,764,589 B2
(45) Date of Patent: Sep. 19, 2017

(54) HANDLE AND CONNECTOR FOR AN ILLUSTRATION UNIT

(71) Applicant: Grace Peele Hilton Dunne, Jacksonville, NC (US)

(72) Inventor: Grace Peele Hilton Dunne, Jacksonville, NC (US)

( * ) Notice: Subject to any disclaimer, the term of this patent is extended or adjusted under 35 U.S.C. 154(b) by 564 days.

(21) Appl. No.: 13/768,309

(22) Filed: Feb. 15, 2013

(65) Prior Publication Data

US 2013/0209155 A1 Aug. 15, 2013

Related U.S. Application Data

(60) Provisional application No. 61/599,031, filed on Feb. 15, 2012.

(51) Int. Cl.

| | |
|---|---|
| ***B43K 23/004*** | (2006.01) |
| ***B41K 1/56*** | (2006.01) |
| ***A46B 5/02*** | (2006.01) |
| ***B43K 23/016*** | (2006.01) |
| ***A46B 15/00*** | (2006.01) |
| *A46B 11/00* | (2006.01) |
| *A46B 5/00* | (2006.01) |

(52) U.S. Cl.

CPC ..... *B43K 23/004* (2013.01); *A46B 5/023* (2013.01); *A46B 5/025* (2013.01); *A46B 15/0093* (2013.01); *A46B 15/0097* (2013.01); *B41K 1/56* (2013.01); *B43K 23/016* (2013.01); *A46B 5/0095* (2013.01); *A46B 11/002* (2013.01)

(58) Field of Classification Search

CPC combination set(s) only.
See application file for complete search history.

(56) References Cited

U.S. PATENT DOCUMENTS

| | | | | |
|---|---|---|---|---|
| 2,236,194 | A * | 3/1941 | Lorber | B43K 23/004 401/6 |
| 5,180,239 | A * | 1/1993 | Bistrack | B43K 23/004 401/6 |
| 5,564,849 | A * | 10/1996 | Greer, Jr. | B43K 5/005 40/334 |
| 6,343,885 | B1 * | 2/2002 | Heyne | B43K 7/005 16/430 |
| 8,348,534 | B1 * | 1/2013 | Brindise | B43K 23/016 401/6 |
| 8,393,812 | B2 * | 3/2013 | Shultz | B43K 23/004 401/6 |
| 2004/0068269 | A1 | 4/2004 | Bonati et al. | |
| 2006/0039739 | A1 * | 2/2006 | Komorowski | B43K 23/004 401/6 |

* cited by examiner

*Primary Examiner* — David Walczak
(74) *Attorney, Agent, or Firm* — Kimberly O Snead; Sheldon H Parker

(57) ABSTRACT

An illustration unit is disclosed for use by people who have less than optimal gripping capability. The handle of the illustration unit has a diameter sufficient to allow the user's pinky, ring and middle fingers come near too or in contact with the thenar while. prevent a user's pinky, ring and middle fingers from contacting a user's proximal or distal palmar. Preferably handle is configured to enable said user to contact a surface with said at least one marking element, said surface being approximately parallel to said user's body. Either the handle or connector can be arcuate, having an interior surface and an exterior surface. At least one connector is dimensioned to be received in the receiving area and the second end to receive a marking element.

8 Claims, 26 Drawing Sheets

950
958
954
956
952
953
959

960
968
966
963
962
969

970
977
976
978
973
972
979

980
988
986
982
989

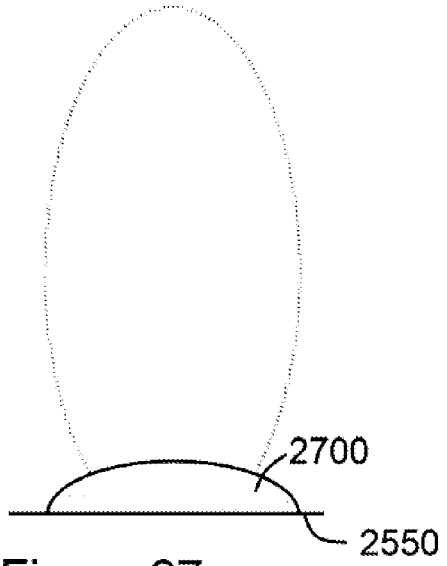
Figure 27
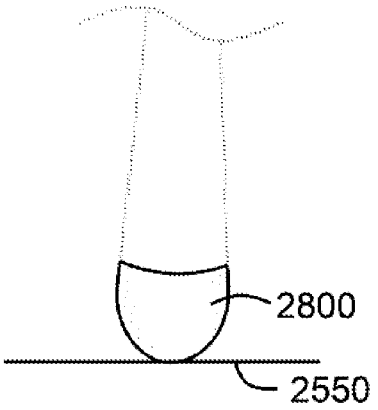
Figure 28
Figure 25
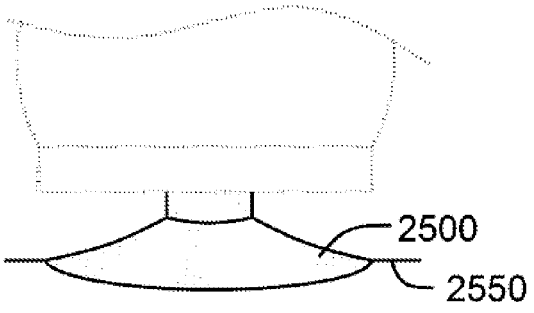
Figure 26
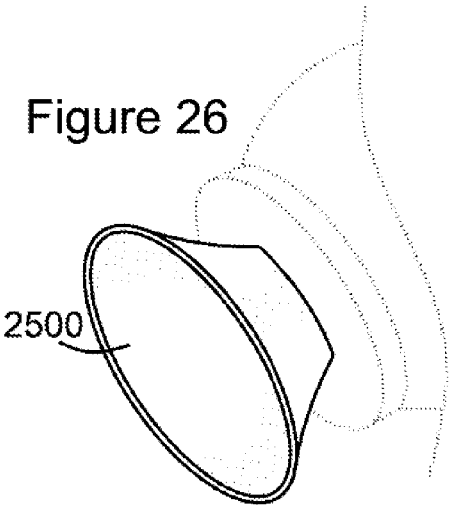

Figure 33
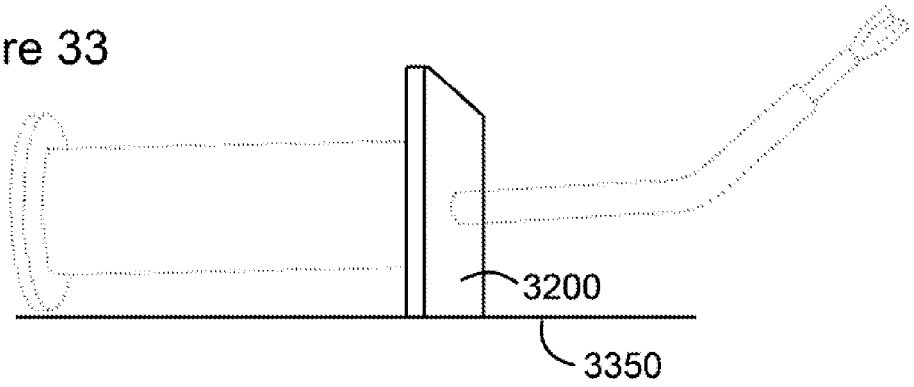
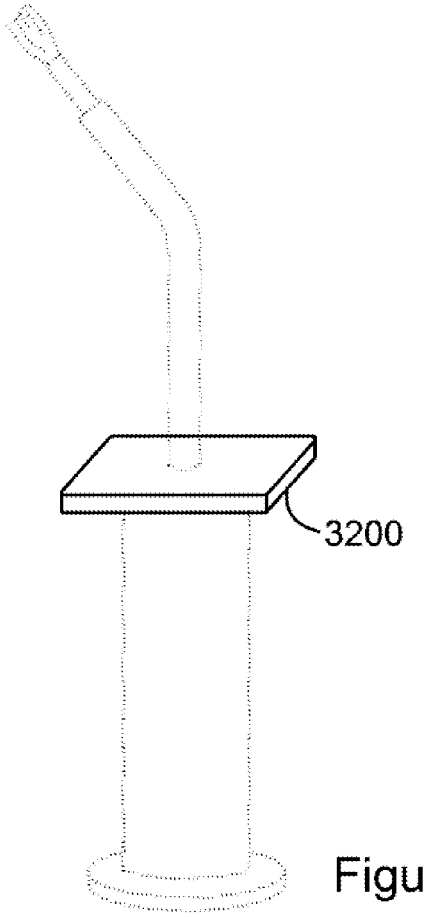
Figure 32

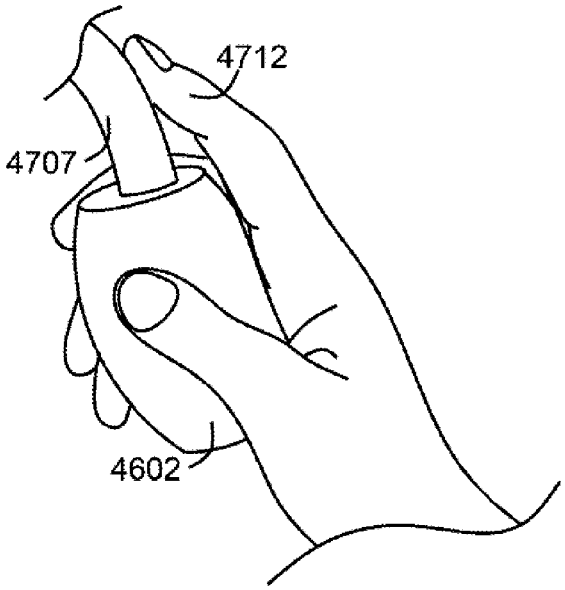
Figure 47
Figure 48
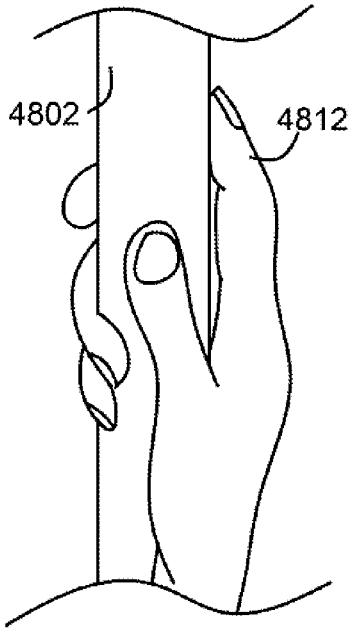
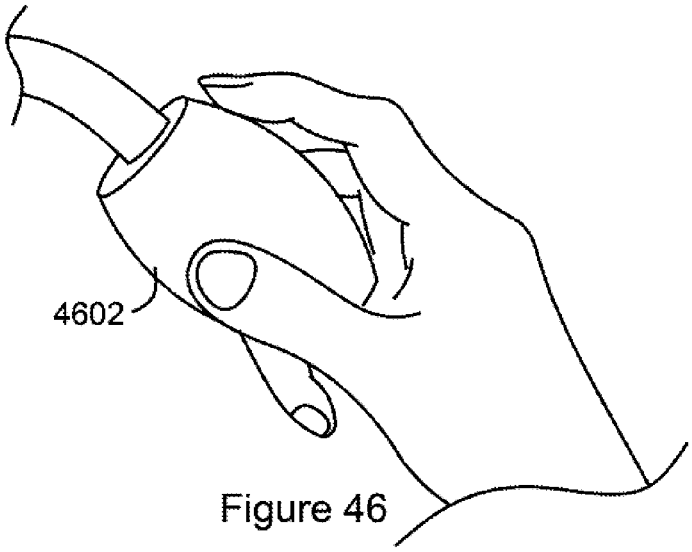
Figure 46

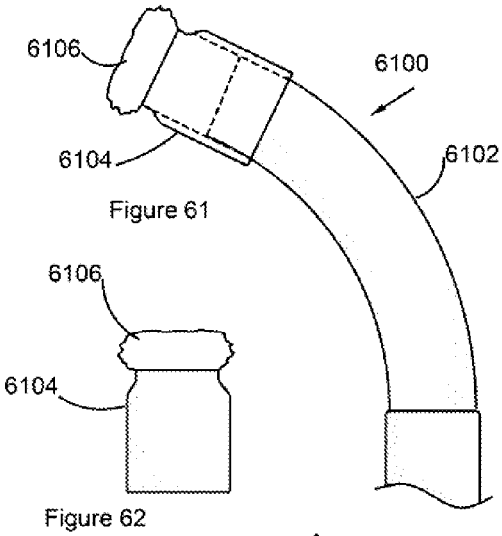
Figure 61
Figure 62
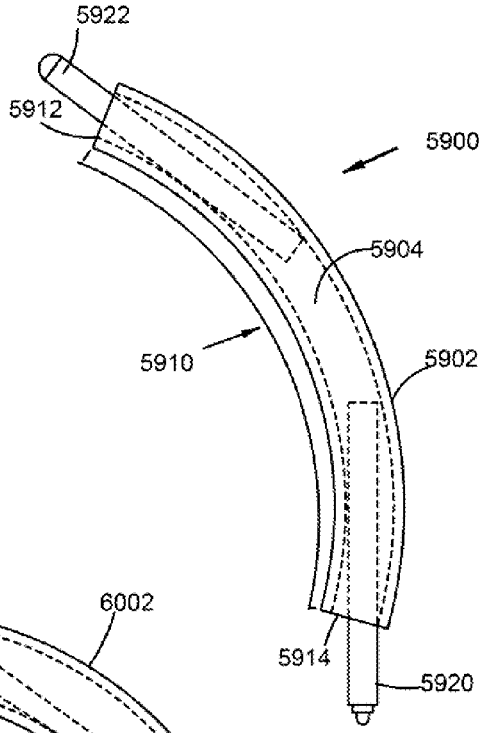
Figure 59
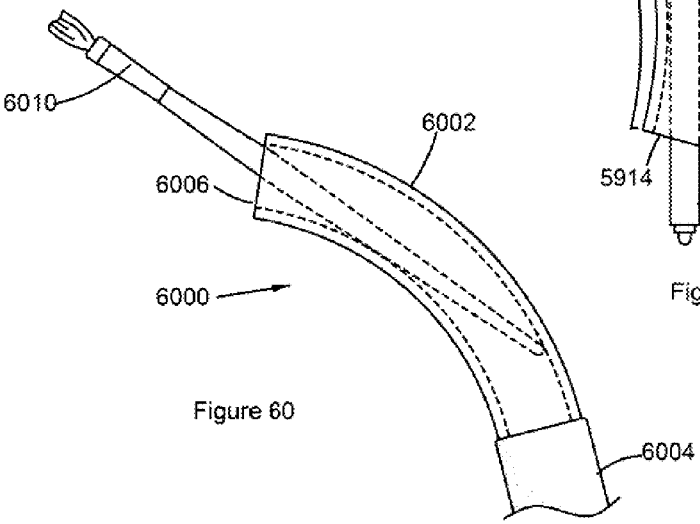
Figure 60

HANDLE AND CONNECTOR FOR AN ILLUSTRATION UNIT

FIELD OF THE INVENTION

This invention relates to a illustration unit that can be used by individuals having problems with gripping marking members.

BACKGROUND OF THE INVENTION

Hand disabilities, or dexterity impairments, have multiple causes and can happen to any age group. The causes of dexterity impairment can be a result of a birth defect, osteoarthritis, polio, various accidents, neurological; the list of causes is extensive.

There are a number of companies that provide aids for performing everyday tasks; however they address the practical side of life. Although the practical side is necessary, for many people, art is an expression of joy and fulfillment. When faced with a dexterity impairment, drawing, coloring, painting, all activities that require holding a small elongated element, are limited or eliminated.

The disclosed illustration units of the present invention were designed to enable the dexterity impaired population to draw, write, paint, etc. through the handle designs and marking element placement.

SUMMARY OF THE INVENTION

An illustration unit is disclosed for use by people who have less than optimal gripping capability. This can include small children as well as people with dexterity impairments. The handle of the illustration unit has a diameter sufficient to allow the user's pinky, ring and middle fingers come proximate too or in contact with the thenar while. prevent a user's pinky, ring and middle fingers from contacting a user's proximal or distal palmar. Preferably the handle is manufactured from, or covered with, a pliable, non-slip material; although in some embodiments the handle can be manufactured from a non-pliable material. In most embodiments the handle is configured to enable the user to contact a surface approximately parallel to their body with at least one marking element.

There is at least one receiving area within the handle dimensioned to receive a marking element, a handle extension, an eraser, or other drawing or painting related item. Each of the receiving areas in either the handle or the connectors can have different interior diameters in order to receive different marking elements.

The handle itself can be arcuate, having an interior surface and an exterior surface, thereby eliminating a connector to hold the marking elements. In some embodiments the interior surface is dimensioned to receive a marking element or handle extension in frictional contact formed by the marking element contacting a first area of the interior surface at two points and a second opposing area of the interior surface at one point.

At least one connector, each having the first and a second end, is dimensioned for a first end to be received in the receiving area and the second end to receive a marking element. In one embodiment the connector is arcuate having an interior surface and an exterior surface. The interior surface is dimension to receive the marking element in frictional contact, which is formed by the marking element contacting a first area of interior surface at two points and a second opposing area of the interior surface at one point. In other embodiments the connector can be adjustable and/or repositionable with respect to the handle. Alternatively, the connectors can be flexible and/or removable to be repositioned within multiple receiving areas within the handle. Multiple connectors can be provided at different angles and lengths for a single handle to enable the user to select the angle in length most comfortable and most applicable for the project.

In some embodiments the illustration unit has a stand to place the marking element at an angle when the unit is resting on a surface in order to elevate the marking element from the surface and prevent rolling. The stand can encompasses the handle to prevent paint from dripping down to the user's hand.

The illustration unit can have a base to maintain an upright position. The base can have a removable securing means, such as a suction cup, or clamp. Storage means can also be incorporated into the handle. In some embodiments the storage means include storage and dispensing of paint.

BRIEF DESCRIPTION OF THE DRAWINGS

FIG. 25 is a side view of a suction cup base.

FIG. 26 is an angled view of a suction cup base.

FIG. 27 is a side view of a basic flat base.

FIG. 28 is a side view of a rounded weighted base.

FIG. 32 is an angled view of a collar.

FIG. 33 is an angled view of a collar with the brush on its side.

FIG. 46 is a side view of a rounded body being gripped by a hand.

FIG. 47 is a side view of a rounded body being gripped by a hand.

FIG. 48 is a side view of an elongated body being gripped by a hand.

FIG. 59 is a phantom side view of an additional embodiment of the invention where the marking element and handle are held in place by friction.

FIG. 60 is a phantom side view of a further embodiment having an affixed handle and the marking element retained in place by friction.

FIG. 61 is a side view of a curved connector with a marking element friction fitted over the outside of the connector.

FIG. 62 is a side view of the marking element of FIG. 61.

DETAILED DESCRIPTION OF THE INVENTION

Definitions

As used herein the term "bristles" and "hair" will be used interchangeably and shall refer to the portion of the brush used for application of a material, such a paint, make up, varnish, etc., and will include natural and synthetic materials.

As used herein the term "brush" will refer to the combination of the bristles and ferrule. The brush in all embodiments can be removable from the connector or can be permanently adhered.

As used herein the term "illustration unit" will refer to the combination of the optional connector, handle and base in conjunction with the selected illustrating medium.

As used herein the term "marking element" will refer to brushes, crayons, pencils, pastels, chalk, stamps or other medium that is used to sketch, paint, write or place a mark onto a surface.

As used herein the term "connector" shall refer to a portion of the illustration unit that extends from the handle to the marking element. In the majority of embodiments one end of the connector is hollow and dimensioned to receive a marking element. However, in addition to hollow tubes connectors can include screws, clamps, clips and any related methods of removably securing two elements. A connector may not be used depending on the embodiment.

As used herein the term "ferrule" shall refer to an portion of the brush typically made of plastic or metal that holds the hairs at one end and is inserted into or onto the connector at the opposing end. In some embodiments, the ferrule and connector can be a single unit.

As used herein the terms "handle" and "body" shall be used interchangeably and refer to an portion of the brush that is gripped.

As used herein the term "toe" shall refer to the tip of the bristles.

Figure 63:
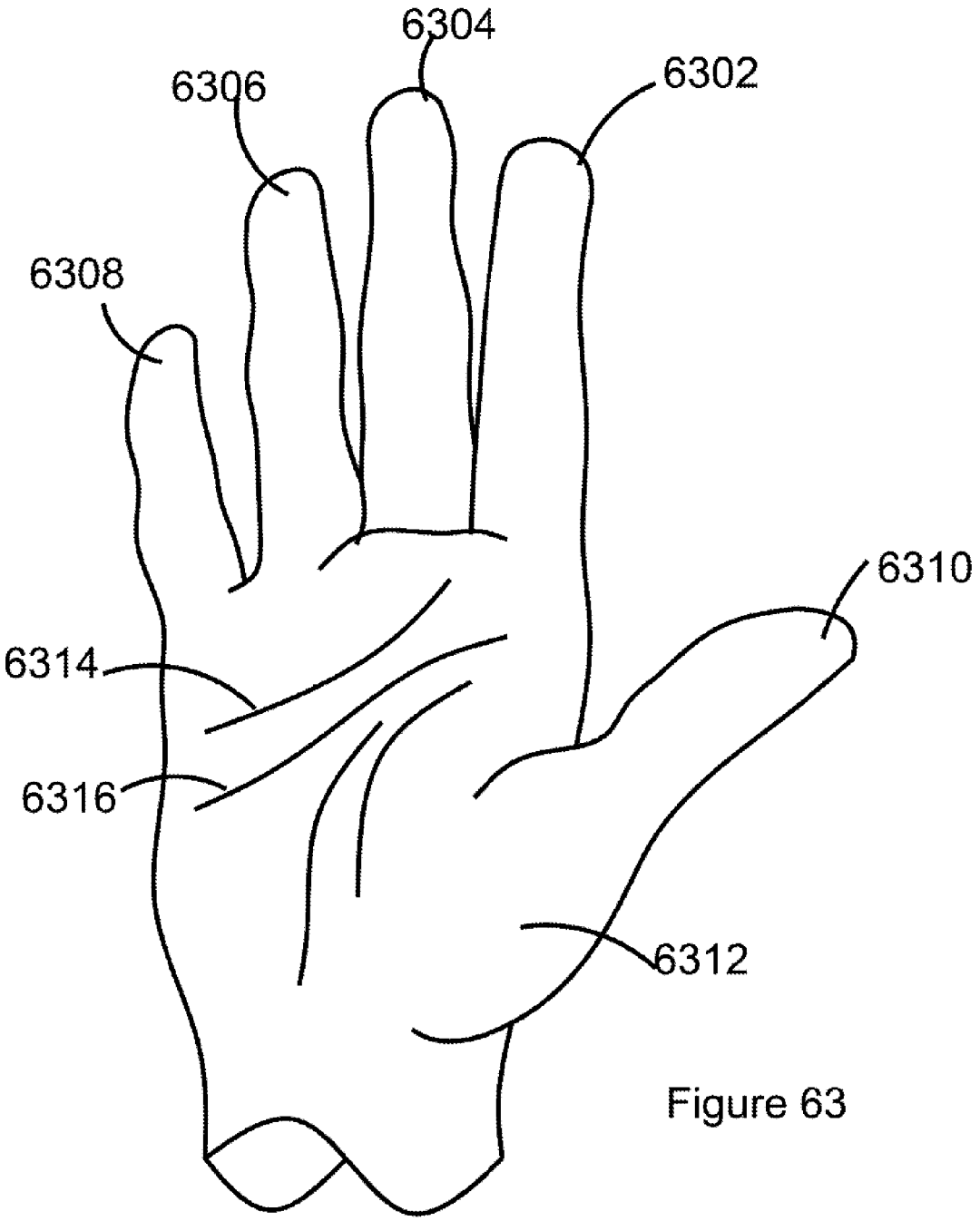
FIG. 63 is a front view of an open hand.

As used herein the term "thenar" refers to the bulge at the base of the thumb as indicated in FIG. 63.

As used herein the term "palmar" refers to the center portion of the palm has indicated in FIG. 63.

As used herein the term "proximate" refers to next or nearest in space or time, very close, very near, immediately before or after in order place the occurrence, etc.

As used herein the term "cylinder" as employed herein is defined as follows:

a. A figure consisting of two parallel bases in the form of congruent, closed curves joined by a smooth, continuous, closed surface; specifically, such a figure having circular bases and a surface perpendicular to the bases.

b. The surface generated by a straight line intersecting and moving along a closed plane curve, the directrix, while remaining parallel to a fixed straight line that is not on or parallel to the plane of the directrix.

c. The portion of such a surface bounded by two parallel planes and the regions of the planes bounded by the surface.

d. A solid bounded by two parallel planes and such a surface, especially such a surface having a circle as its directrix.

The purpose of the disclosed illustration units is primarily to provide the ability to paint, color or sketch for those who are unable to do so or are limited due to disabilities. There are many reasons that people cannot hold a standard paintbrush from birth defects to arthritis to injury such as carpal tunnel syndrome to illness. Children, with their smaller hands and less refined motor skills benefit as well, although there is no age category to which this is restricted. Healthy individuals can use the illustration units as well, and may wish to do so due to the improved ergonomics to prevent future injury. Further, in some embodiments the connector can be lengthened to enable full use of a chalk, white board, walls, or any other surface on which one wishes to write illustrate draught design stamp war paint.

The ergonomic features include not requiring the artist to arch and bend the wrist. Many of the designs extend farther than a standard brush, reducing the required reach of the artist. Many of the designs also "point to" the intended target, reducing or even eliminating the need for the artist to bend their wrist or hand. Finally, many offer further ergonomics by providing a body that is easily gripped and held.

As the disclosed illustration unit is designed to assist people when writing on a surface that is approximately at right angles to the ground, or a proximately parallel to the users body, such as chalk board, easel, white board, etc, the disclosed illustration until is designed to position the hand at a generally parallel to the writing surface. Depending upon the person, however, the illustration units disclosed herein can be used to write on surfaces parallel to the ground. For the majority of user, the units will be used to facilitate painting, sketching, etc. as well as work on whiteboards and chalkboards.

Although most of the handles illustrated herein are simple, more fanciful forms can be used, including but not limited to fruits, fishing poles, animals, etc., to provide specific appeal for an age group. It is not so much the design of the handle that is critical but it's the graspability achieved through a combination of end user size dimensioning and materials.

The designs disclosed herein, and corresponding to the hand illustration of FIG. 63, are dimensioned so that although the tips of the pinky finger 6308, ring finger 6306 and middle finger 6304 can come proximate to, or in contact with, the thenar 6312, however never wrap so tightly that they contact either the proximal palmar 6316 or distal palmar 6314. This releases the tension on the hands and prevent cramping and strain on the muscles. Each handle further enables the user to have a range of grips to further release muscle tension. The handles are preferably manufactured from a soft, pliable, no slip material that will enable the user to change grip positions and tension, without the handle slipping. As illustrated heretofore, the index finger 6302 can either wrap the handle in the same fashion on as the pinky finger 6308, ring finger 6306 and middle finger 6304 or it can extend along the handle in a direction to provide support. The thumb 6310 generally wraps the handle in the opposing direction from the pinky finger 6308, ring finger 6306 and middle finger 6304. The grip on the handle will differ from person to person, however the common problem for those achieving benefit from the disclosed units is the inability to maintain the grip required to hold something with a handle having a small diameter, such as a paintbrush, marker or chalk.

The diameters of the handles disclosed herein are dependent upon the size of the user's hand. A minimum diameter would be about 0.5 inches and a maximum diameter would be about 3 inches. The dimensions can vary +/−15% and any variation will be obvious to those skilled in the art. As stated heretofore the intent is to release tension on the hands and prevent the fingertips from contacting the proximal or distil palmar.

The connectors disclosed herein are at a number of different angles/arcs depending upon the needs of the person and the end use. For example, the angles/arcs would be most beneficial for working on a surface at or above elbow level while a straight connector would be beneficial for work at elbow level or below. Again, however, this will be dependent upon the user and the end use.

Standard paintbrushes require manipulation by the thumb, forefinger and middle finger with additional gripping with the ring and pinky. Most of the handles as disclosed, are designed for grasping with the entire hand with the connector angle and placement determining the angle between the user's hand and the receiving surface.

The sizes of the handles are dependent upon the hands of the user, although some of the handles can be used by a larger range of hand sizes. However, it is unlikely that a six foot male would be comfortable using a handle dimensioned for a toddler.

It is important to note that although brushes are predominately used herein as an example, this should not be considered as a limiting factor. The only alteration between the use of a brush, pencil, pastel, crayon or other marking element is the style and size of the connector. Further, the connectors, in some embodiments, can be removable from the handle to permit connectors having a variety of distal diameters to be used. Other embodiments accept a larger range of marking elements due to the friction fit between the marking element and connector.

Each figure is described as illustrated and it should be noted that the handles illustrated herein are representative and that the illustrated handles can be interchanged. Additionally other designs and shapes can be easily used for handles. The marking elements can be removable, as would be applicable for the pencil, pastels, etc., or permanent as could be used for brushes.

Each marking unit is made from several elements, and may have some or all of the elements.

The first element is a "base", this is the portion that rests against a surface when not in use. FIGS. 25 through 28 show example base variations. Bases can include suction cups 2500 that secure to flat surfaces 2550 to hold the brush perpendicular to the surface, flat bases 2700 that allow the brush to rest without toppling, rounded weighted portions 2800, and the like.

Figure 30:
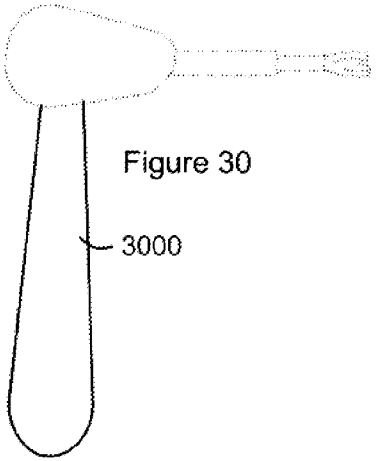
FIG. 30 is a side view of an elongated body.
Figure 31:
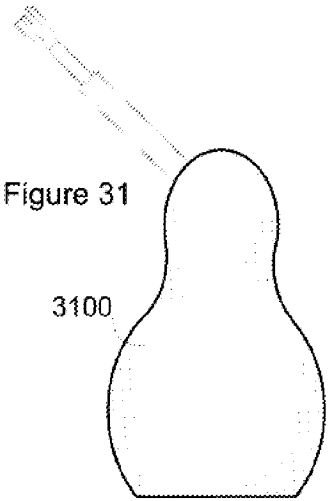
FIG. 31 is a side view of a multi-sectioned body.
Figure 29:
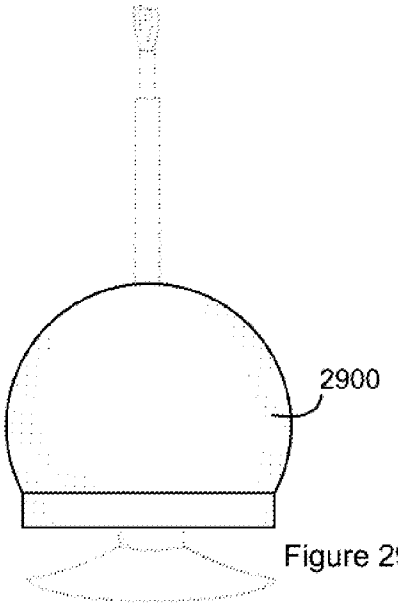
FIG. 29 is a side view of a rounded body.
Figure 34:
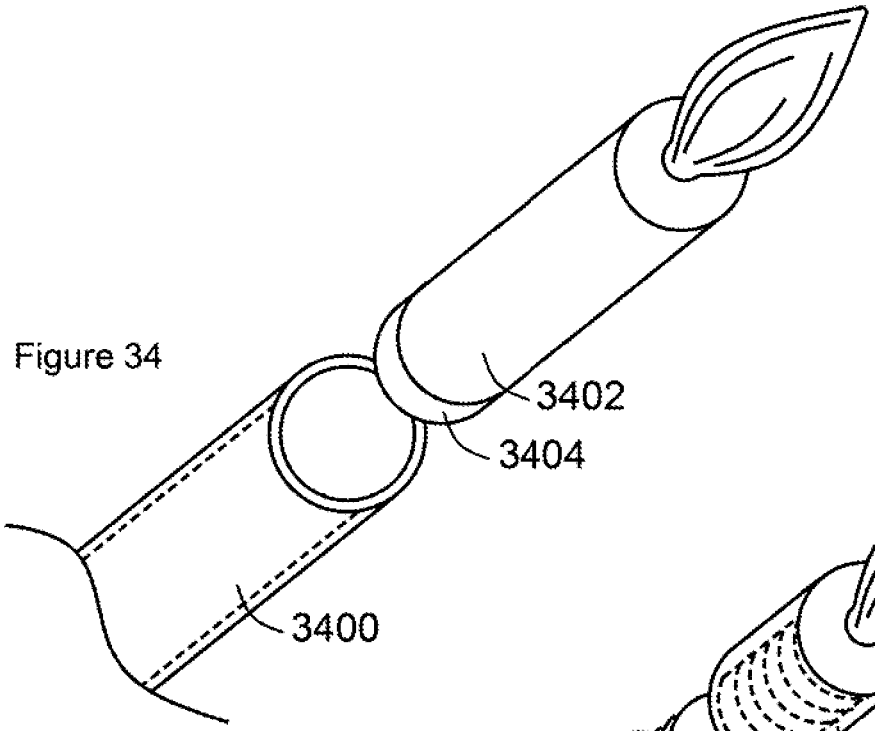
FIG. 34 is an angled view of a tube connector and marking element.

The second element is the "handle" or "body", this is the portion where the fingers and palm will touch the unit when in use. FIGS. 29 through 31 show example body variations. The handle can vary greatly to accommodate different size hands and grip types, and can include rounded handles 2900, elongated handles 3000, multi-segmented handles 3100 and more. The third element is the "collar", this is the portion that protects the brush handle and users hand from dripping paint from the marking element. FIG. 32 shows a collar 3200, which is typically wider than the handles. In addition, as shown in FIG. 33, when not in use the collar 3200 can be used to prevent the brush tip from touching the surface 3350 on which it is resting. In preferred embodiments the collar is of such a shape so as not to roll when placed on a flat surface. This can be accomplished by having at least two points of the collar touching the flat surface. Examples include a regular polygon where a flat side is placed against the flat surface, an irregular polygon where at least two points are against the flat surface. Rounded shapes can be used as long as there are two or more points that will connect, such as with a flower petal shaped collar where two of the petals are touching the flat surface.

Figure 35:
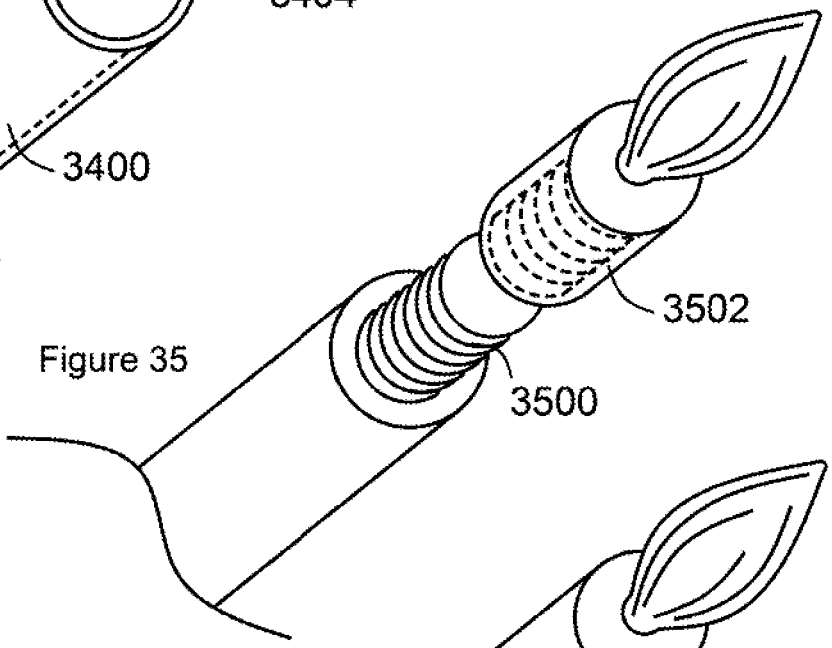
FIG. 35 is an angled view of a screw connector and marking element.
Figure 36:
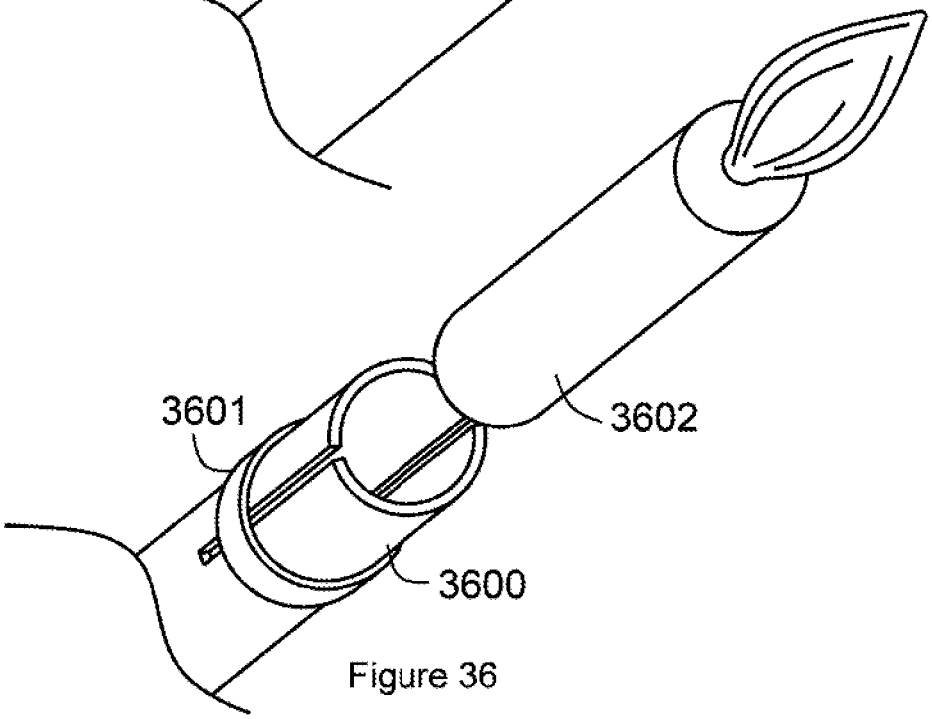
FIG. 36 is an angled view of a tube connector with tightening ring and marking element.

The fourth element is the "connector", this is the portion that connects the handle and the marking element. FIGS. 34 through 38 show examples of connector variations. Examples include using a hollow tube connector 3400 that the marking element 3402 slides into. The connector 3400 and marking element 3402 can both be metal, plastic or other rigid material. They can also be lined with rubber or similar material to improve grip between the two. In a preferred embodiment of this example, the connector 3400 is magnetic and marking element 3402 has a magnetic base 3404. The magnetic strength should be enough to prevent the marking element 3402 from slipping out of the connector 3400, but still enabling the user to easily remove the marking element 3402 from the connector 3400 with their hands. In FIG. 35, a threaded screw connector 3500 mates with the marking element 3502 to provide a secure connection. In FIG. 36 a split hollow tube connector 3600 which includes a tension ring 3601 is used to put pressure on the marking element 3602 to firmly secure it. The tension ring 3601 is moved away from the receiving opening to reduce pressure and release the marking element 3602. Other variations of the connector include an alligator clip 3700, and an adjustable clamp 3800.

The fifth element is the "marking element", this is the portion which contains the medium, such as paint, crayons, chalk, markers, coal, graphite, or other such artistic materials. In most embodiments, the marking element has a body such as a metal ferrule (that will attach to the unit connector) and the head such as bristles for a brush (which will receive paint).

The body of the illustration units disclosed herein can be made of a wide variety of materials including silicone, rubber, metal, plastic or a combination thereof. Plastics provide an inexpensive and disposable option. Metals, rubbers, and plastics are all washable and reusable. The bodies can be any of the applicable shapes and designs as described hereinafter as well as any that are designed in the spirit of the application The sizing of the marking element varies based upon certain factors. When the intended user is a child, for safety reasons the marking element should be of a large enough size as to make swallowing the marking element difficult. In addition, when for child use non-toxic materials should be used in the event that the marking element is swallowed.

Examples with variations and combinations of the base, handle, collar, connector and marking element are disclosed hereinafter. FIGS. 1 through 24 are potential combinations, but most elements can be swapped to form marking units not depicted herein.

Figure 1:
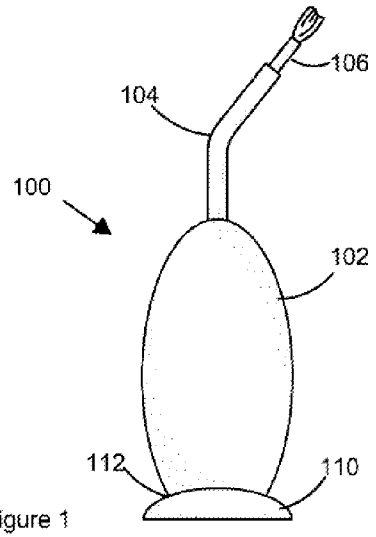
FIG. 1 is a side view of an oval shaped handle having an angled connector extending from the top and a base, in accordance with the invention.

In FIG. 1, the illustrating unit 100 has an oval body 102 having a base 110 at one end and an angled connector 104 at the opposing end. The removable marking element 106 has been placed into the connector 104 and the unit 100 is ready for use. In this Figure, the base 110 extends beyond the connection point 112 between the base 110 and the body 102. Although this provides added stability when using the soft materials, it is not necessary with all materials. The base 110 is manufactured separate from the body 102 in this illustration, and subsequently adhered together, however when the unit 100 is molded, the base 110 and body 102 can be a single piece.

The connector 104 is structurally rigid and can be manufactured from any lightweight material, such as plastic or aluminum that will receive the ferrule, base or body of a marking element 106. The connector in this embodiment extends from the top of the handle 102 and has a slight angle. The connector 104 can be adhered to the body 102 or it can be removable, thereby enabling the user to change connectors, providing different relationship between the user's hand and the bristles to accommodate for different positions.

Figure 2:
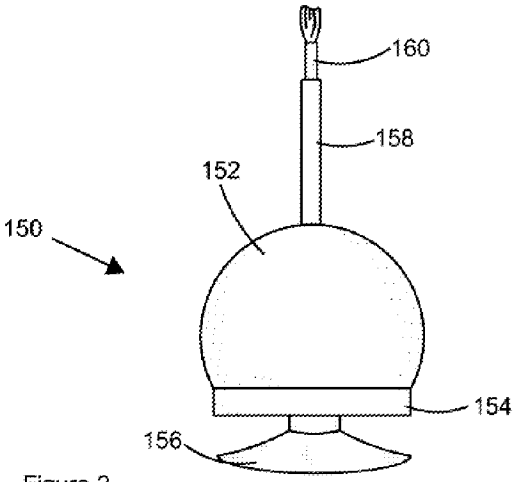
FIG. 2 is a rounded handle having a straight connector extending from the top and a suction cup base, in accordance with the invention.

In FIG. 2, the handle 152 of the illustration unit 150 is cut to fit flush with the base 154, which, in turn, is mounted on a suction cup 156. The connector 158 extends straight from the top of the handle 152 into which the marking element 160 is inserted.

In this design, the base 154 is used to receive the suction cup 156 and handle 152 and is a rigid or semi-rigid material to prevent the suction cup 156 from tearing out of the softer material of the handle 152.

In embodiments where the handle 152 is manufactured from a rigid, or semi-rigid material, the suction cup 156 can be directly affixed to the handle 152.

Figure 3:
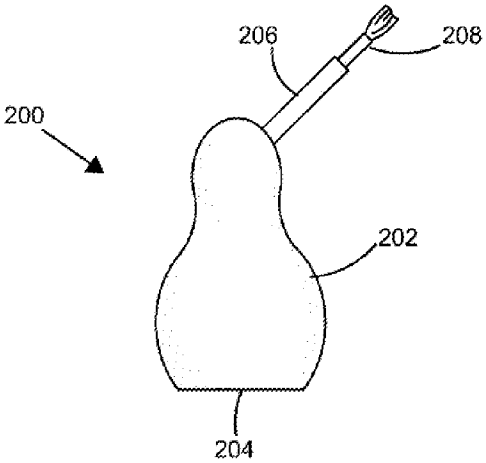
FIG. 3 is a side view of a pear shaped handle having an straight connector extending at an angle from the side and a flattened bottom to form the base, in accordance with the invention.

In FIG. 3 the handle 202 of the illustration unit 200 is a pear shaped with a flat end forming the base 204 on which to sit the unit 200. The connector 206 is straight and positioned on the side of the handle 202 toward the top thereby providing an angle between the connector 206 and the base 202.

In this embodiment, the base 204 must have sufficient surface area to counter the weight of the connector 206 and marking element 208. Too narrow of a base 204 and the handle 202 will tip.

Figure 4:
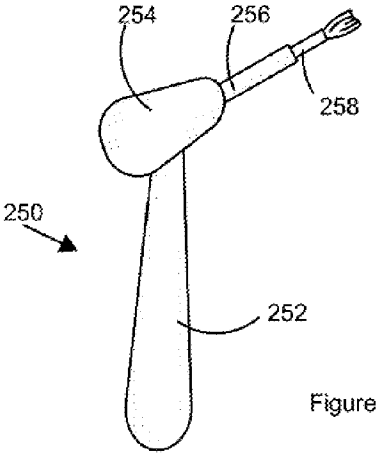
FIG. 4 is a side view of a T-shaped handle having a straight connector extending from the end of the T, in accordance with the invention.

In FIG. 4 the illustration unit 250 has a narrower handle 252 than the embodiment illustrated in FIGS. 1-3, however it must not be so narrow as to lose the ability to grip it as one would a baseball bat. The handle 252 has a head 254 that is, in this embodiment, set at about a 120 degree angle to the handle 252. The head 254 has connector 256 either removably inserted into the head 254 or permanently adhered to the head 254. The marking element 258 is inserted into the connector 256 in a manner described heretofore. In alternative embodiments the angle between the handle 252 and the head 254 can range from about 90 degrees to about 140 degrees depending upon end use.

Figure 5:
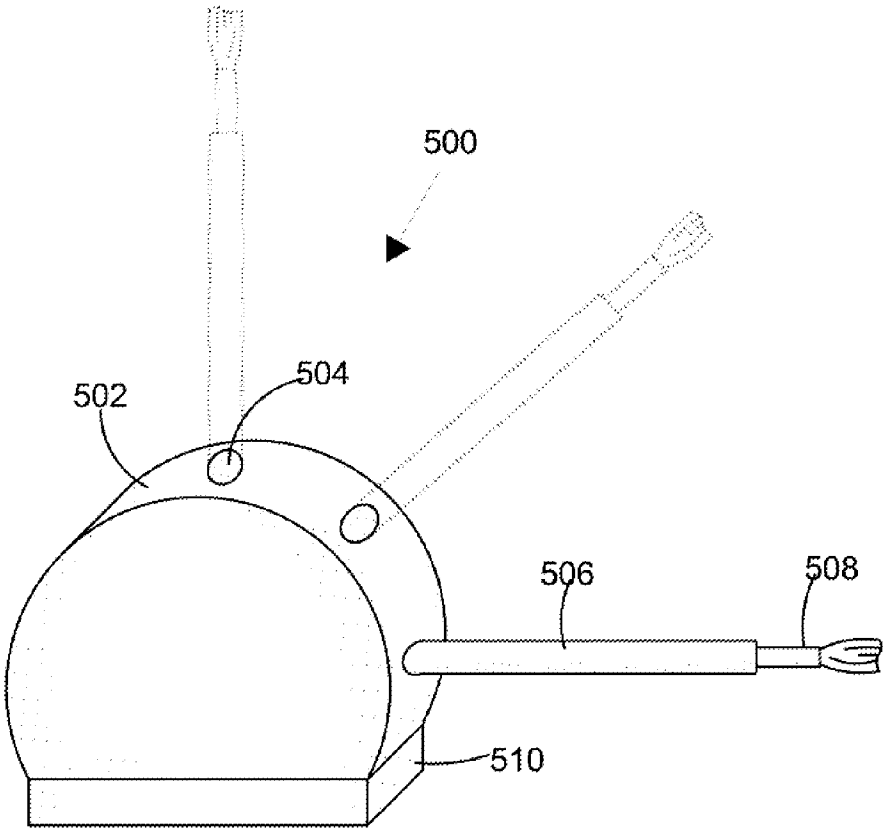
FIG. 5 is a perspective side view of a handle having multiple receiving areas for the connector, in accordance with the invention.

In FIG. 5, the handle 502 of the illustration unit 500 is oval shaped with multiple receiving areas 504 for the connector 506 carrying the marking element 508. The handle 502 is cut, or formed, to securely fit within the base 510 when manufactured as two separate pieces. The handle 502 in this embodiment, must be manufactured from a material having the rigidity to maintain its shape and integrity during repeated positioning of the connector 506. The material can be rigid, such as wood or plastic, and, if desired, covered by a softer material in order to maintain the comfortable feel. The multiple positioning of the connector 506 enables the angle between the user's hand and the marking member 508 to be altered. This is advantageous for changing positions, such as from standing to sitting, as well as specific elements (brush, pencil, crayon, etc) and users.

The handle 502 in this illustration is rounded, however other shapes can be used that are convenient for gripping.

This embodiment is a good example of the flexibility of multiple sized connectors having a proximal end dimensioned to be received within the receiving area 504 and a distal end dimensioned to receive various marking elements 508. In this way, the same illustration unit 500 can be used with the connectors 506 easily removed and replaced with the appropriate connector 506 to received the marking element 508 currently in use. In some embodiments the end of the connector receiving the marking element 508 can be larger to accommodate chalk or other mediums while still enabling the connector to be received within the receiving area 504.

Figure 6:
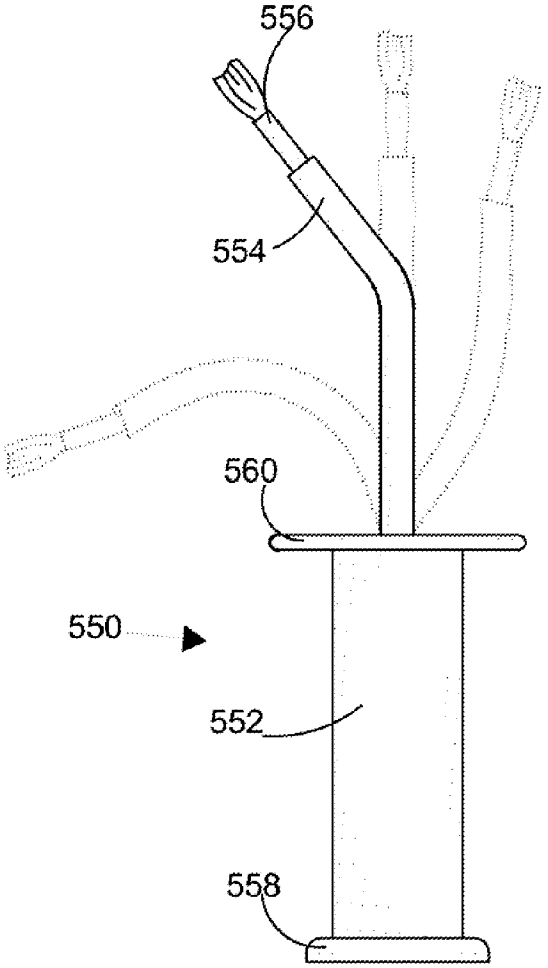
FIG. 6 is a side view of a handle having a flexible connector and a brace, in accordance with the invention.

In FIG. 6 the adjustability is provide by a flexible or articulated connector 554 that is placed in the handle 552. In this Figure, the connector 554 and marking element 556 are extending from the top of the handle 552 and a collar 560 has been added at the top of the handle 552, opposite the base 558. The handle 552 in this embodiment is manufactured from foam, although other materials can be used. In alternative embodiments the girth and length of the handle 552 can be varied greatly to accommodate different hand sizes. To prevent tearing of a soft foam by the connector 554 as it is moved from position to position, a center core of wood or other sturdy material can be used, with the soft foam surrounding the core. Alternatively, the foam can be a firmer, closed cell foam that will withstand the movement of the connector 554. In high use instances, such as schools, using a solid or otherwise sturdy, durable core such as silicone rubber would extend the life of the brush.

Figure 7:
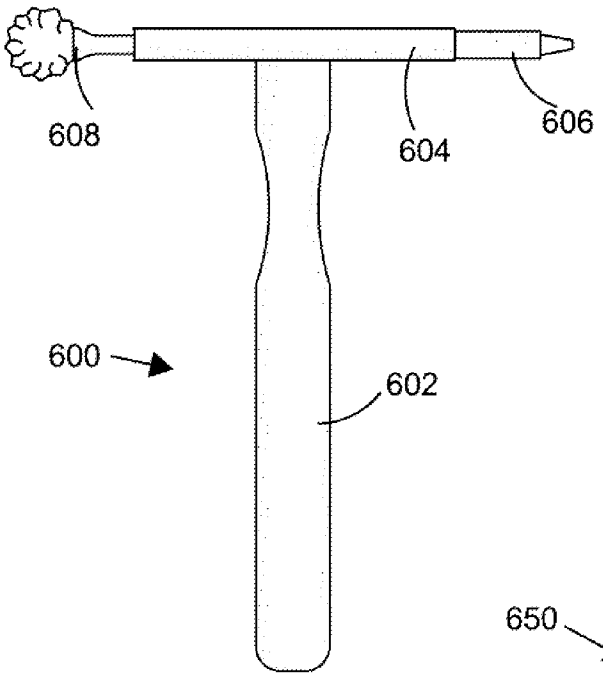
FIG. 7 is a side view of a dual marking element unit having a handle with a T shaped connector, in accordance with the invention.

In FIG. 7 the handle 602 is shaped for gripping with the connector 604 forming a T-shape at the top of the handle 602. Either end of the connector 604 is at least partially hollow in order to receive the marking elements 606 and 608. This places the marking elements 608 and 606, in this embodiment, at right angles to the handle 602, however the angle can be altered between the connector 604 and the handle 602, thereby bringing one marking element at less than 90 degrees and the other more than 90 degrees from the handle 602. In this example the marking element 606 is a pastel while the marking element 608 is an element for smudging the pastel. Alternatively the marking unit 606 can be a pencil and the marking unit 608 an eraser, or any other combination that will be applicable to the art project.

Figure 8:
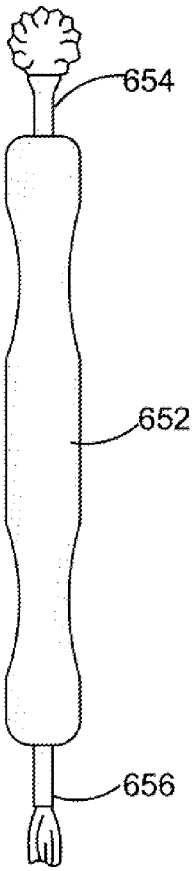
FIG. 8 is a side view of a dual marking element unit having a handle with marking elements at each end, in accordance with the invention.

The illustration unit 650 of FIG. 8 has a handle 652 with the marking elements 654 and 656 directly inserted into the ends of the handle 652.

Figure 9:
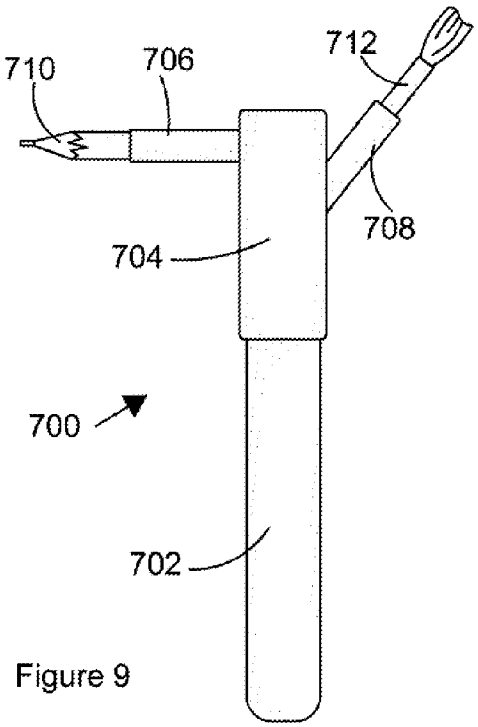
FIG. 9 is a side view of a dual marking element unit having a handle with connectors and marking elements extending at angles, in accordance with the invention.

Another dual element design is illustrated in FIG. 9 the handle 702, in this embodiment, is partially covered with a sleeve 704 to which the connectors 706 and 708 are affixed. The sleeve 704 can be simply a design issue, having no functional value, or can be proportioned to provide a thumb rest. Alternatively the sleeve 704 can be removable, enabling other sleeves 704, containing different angled connectors 706 and 708 to be inserted into or onto the handle 702. In this illustration, the connector 706 carrying the marking element 710 is at a right angle to the sleeve 704 and the connector 708 retaining the marking unit 712 is placed at a non 90 degree angle. In this embodiment the angle between the connector 708 is greater than 90 degrees to the lower portion of the connector 704 and less than 90 degrees to the upper portion of the connector 704.

Figure 10:
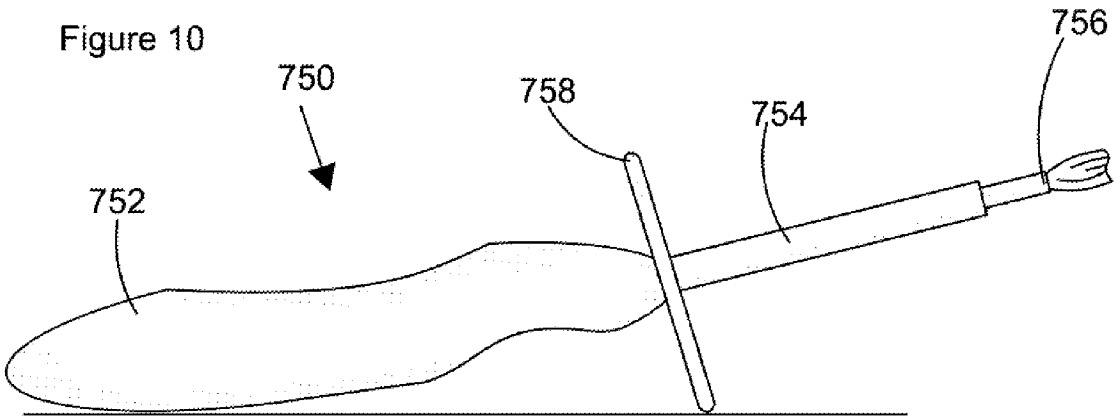
FIG. 10 is a side view of a illustration unit having a support collar, in accordance with the invention.

In FIG. 10 the handle 752 of the illustration unit 750 is long and shaped for easy gripping, although other shapes can be used as noted heretofore. Between the handle 752 and connector 7504 is a collar 758 that prevents the marking element 756 from contacting the table or surface upon which the handle 752 is resting or rolling upon that surface. The collar 750 is polygon in shape such that there is a flat edge of the collar 750 in contact with the table or other surface. Additionally, in some embodiments the collar 750 serves as a drip guard to protect the user's hand. The collar 750 can be any shape, however if a round handle 752 is used the collar 750 will need a shape that prevents rolling.

Figure 11:
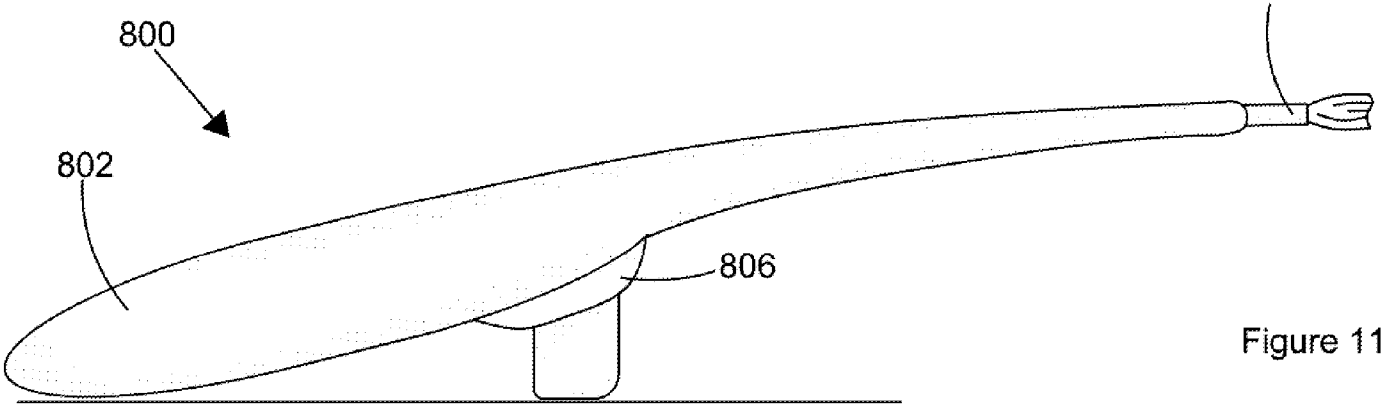
FIG. 11 is a side view of an illustration unit having a support leg, in accordance with the invention.

In FIG. 11 the handle 802 of the illustration unit 800 extends in a slight arc with a decreasing diameter. The marking element 804 is directly inserted into the end of the handle 802. A support base 806 is provided to maintain the marking element off the surface and prevent rolling.

Figure 12:
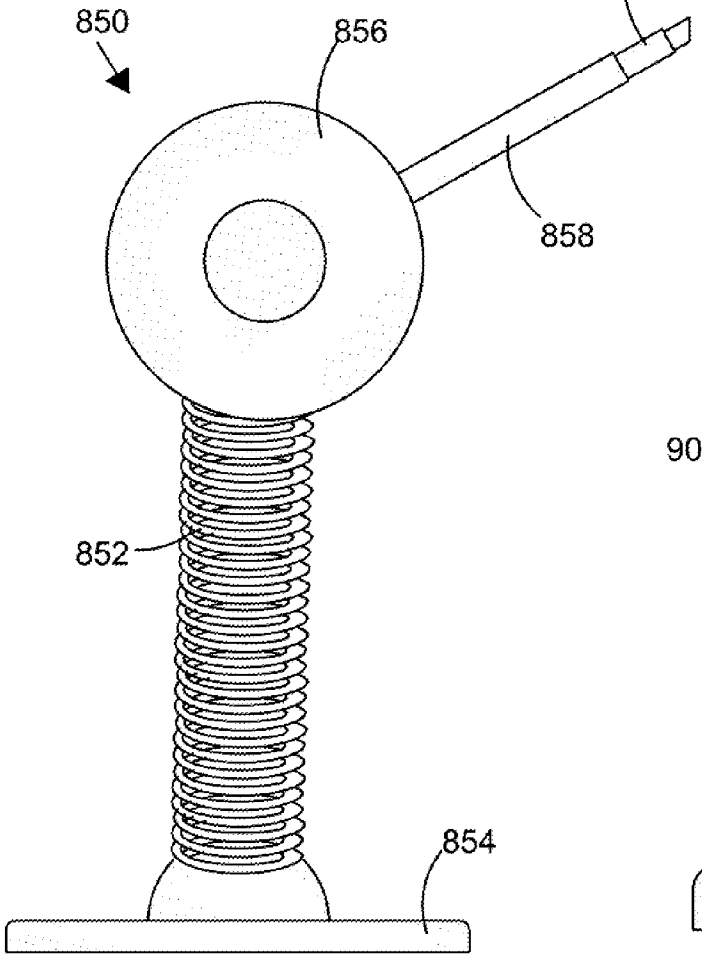
FIG. 12 is a side view of an illustration unit having multiple connector inserts to provide adjustability, in accordance with the invention.

The illustration unit 850 of FIG. 12 has, in this illustration, a round body 856 attached to a spring 852 that has been placed between the handle/base unit 854 and the body 856. The connector 858 is placed into the body 856 in this embodiment at an angle, however one or more receiving holes (not shown) can be placed along the body 856 as desired. The marking element 860 is placed into the connector 858 as described in other embodiments herein.

Figure 13:
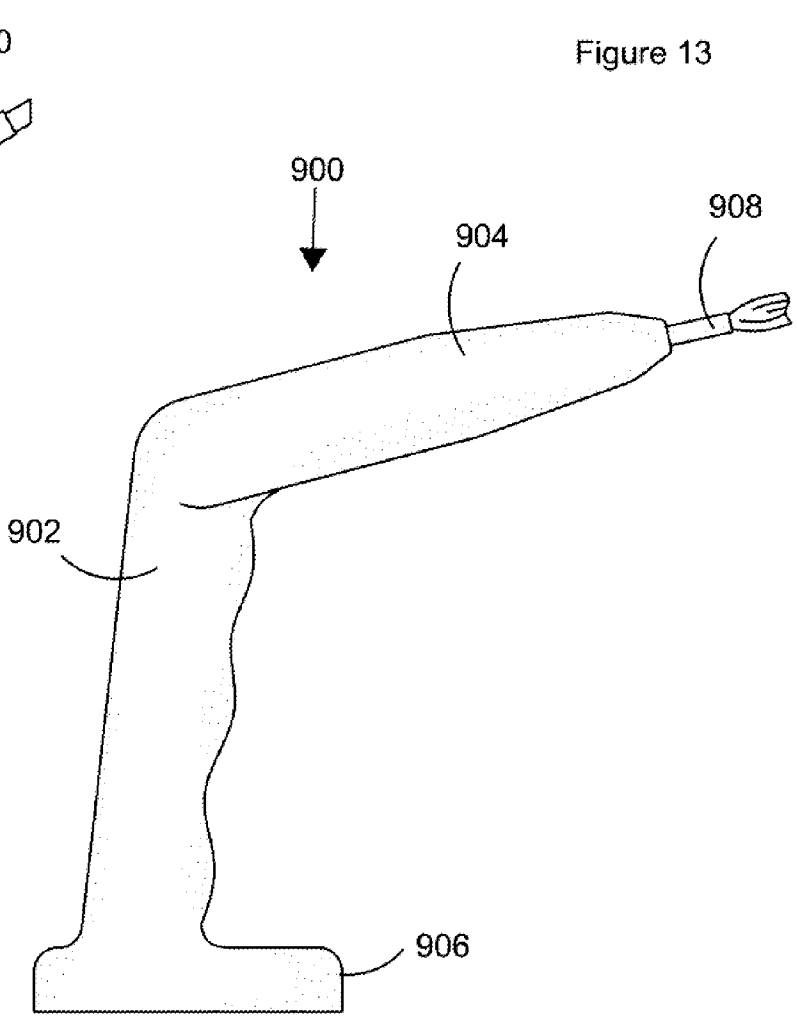
FIG. 13 is a side view of a angled handle with a base, in accordance with the invention.

The one-piece illustration unit 900 of FIG. 13 is a single molded piece having a handle 902 and contiguous angled connector 904. Although the base 906 in this illustration is also molded as part of the handle 902, the base 906 can be a separate unit. The connector 904 is at a slight angle in this illustration, however this should not be considered a limitation as other angles can be used to bring the marking element 908 to the desired position.

In FIGS. 14-17 the illustration units 950, 960, 970 and 980 all have refillable bodies 952, 962, 972 or 982. The brushes 958, 968, 978, 988 can easily be replenished with paint by squeezing the body 952, 962, 972 or 982 respectively. It should be noted that the feeder tubes 956, 966, 976, and 986 and the brushes 958, 968, 978, and 988 respectively must be in fluid communication, thereby requiring any intervening elements to be hollow. The feeder tubes 956, 966, 976, and 986 must be long enough to reach all of the paint in the body 952, 962, 972 or 982. The feeder tubes 956, 966, 976, and 986 are preferably made from Teflon or silicone rubber to enable the paint to flow smoothly, and have a tapered opening 959, 969, 979, 989 to further prevent clogging. Teflon provides superior flow, and silicone rubber provides low cost. In the preferred embodiment, Teflon is used for the feeder tubes 956, 966, 976, and 986 and silicon rubber is used for the body 952, 962, 972 or 982 to provide the best balance of cost and quality. The brushes 958, 968, 978, and 988 fit over the feeder tubes 956, 966, 976, and 986, such that the tapered opening is narrower than the opening of the brush 958, 968, 978, and 988 to create improved pressure for the paint.

Figures 14, 15, 16, 17:
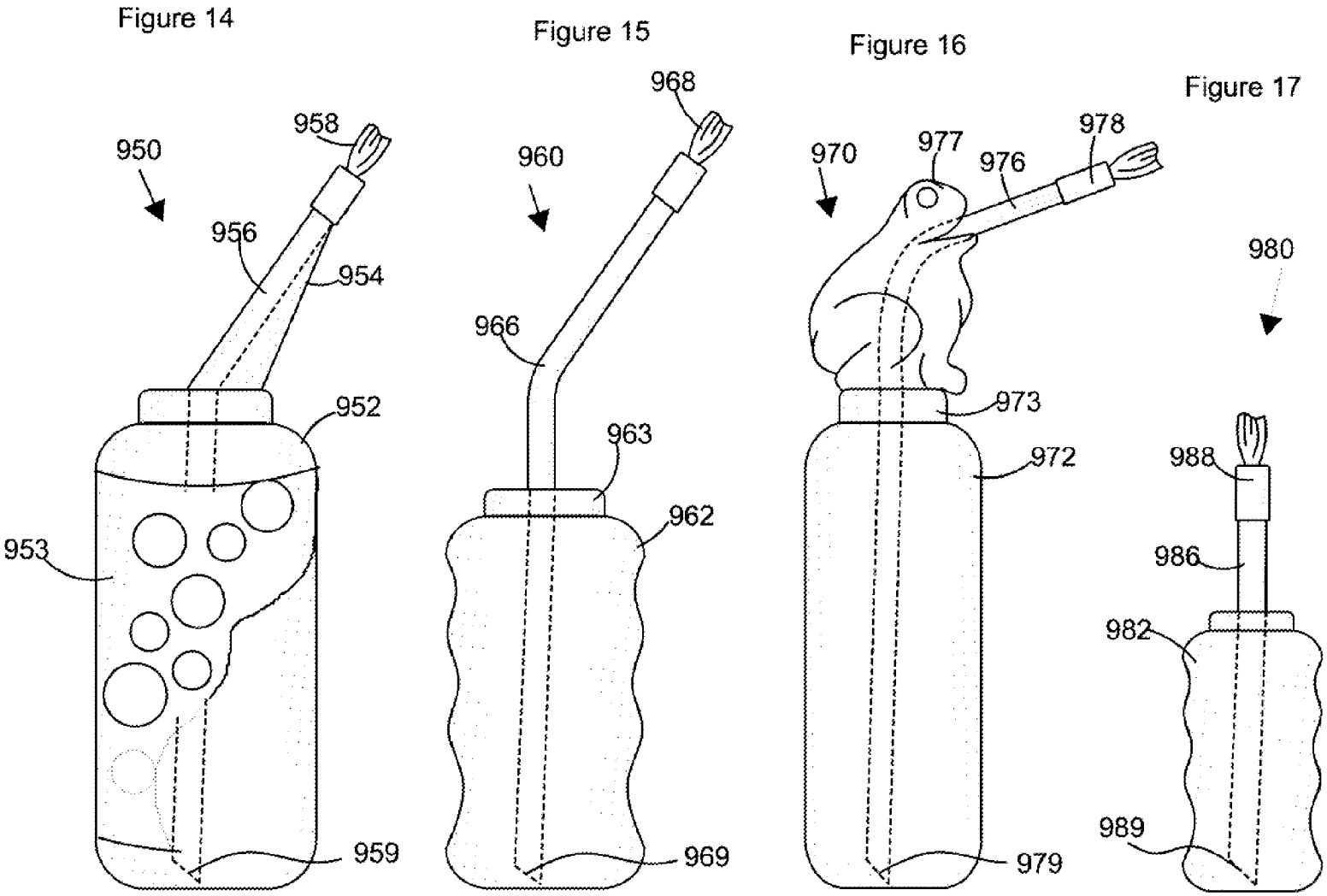
FIG. 14 is a side view of a refillable illustration unit having an angled sleeve to receive the feed tube, in accordance with the invention.
FIG. 15 is a side view of a refillable illustration unit having an angled feed tube, in accordance with the invention.
FIG. 16 is a side view of a refillable illustration unit having an angled feed tube using a guide, in accordance with the invention.
FIG. 17 is a side view of a refillable illustration unit having a straight feed tube, in accordance with the invention.

The illustration unit 950 of FIG. 14 has an angled sleeve 954 extending from the top of the refillable body 952. A feeder tube 956 extends from the bottom of the interior of the body 952, through the sleeve 954 to the brush 958. In this embodiment, the feed tube 956 can, if desired, receive structural support from the sleeve 954, although the extend of the support will depend upon the sleeve 954 and the quantity of contact between the two elements. In this illustration a decorative cover 953, or shell, has been slid over the body 952. This would not only provide a customizable grip but would facilitate washing and can be incorporated on any design taught herein.

The refillable unit 960 of FIG. 15 uses a self-supporting feeder tube 966 that transports the paint from the body 962 to the brush 968. In this embodiment the feeder tube 966 extends straight out of the body top 963 for a short distance and then angles. This is an example the angling, or lack thereof, can be altered based on manufacture preference.

Additionally, the feeder tube 966 can be flexible to permit adjustability. The flexibility is preferably limited to keep the feeder tube 966 rigid enough to be used for painting, as well as not allowing excessive flexing that would prevent the paint from easily flowing through the feeder tube 966.

In the illustration unit 970 of FIG. 16 a decorative element 977 is placed on the cap 973 to maintain the feeder tube 976 at the desired angle. As with all embodiments, the feeder tube 976 and the brush 978 must be in liquid communication. In this example a frog is used as the decorative element 977 and maintains the feeder tube 976 at an approximately 140 degree angle from the body. An angle greater than 90 from the body is preferable to provide better visibility of the brush 978 and prevent clogging. It will be obvious that other animals, flowers, shapes, etc., can be incorporated to maintain the feeder tube 976 at the desired angle. The decorative element also provides greater stability to the feeder tube 976.

The illustration unit 980 of FIG. 17 has a undulating body 982 for ease of grip. The feeder tube 986 extends straight from the body 982, ending with the brush 988.

Although brushes are illustrated herein for use with paints, it should be noted that any liquid can be contained within the refillable units and that any means for transferring the liquid to a surface can be incorporated.

Figures 18, 19, 20, 21:
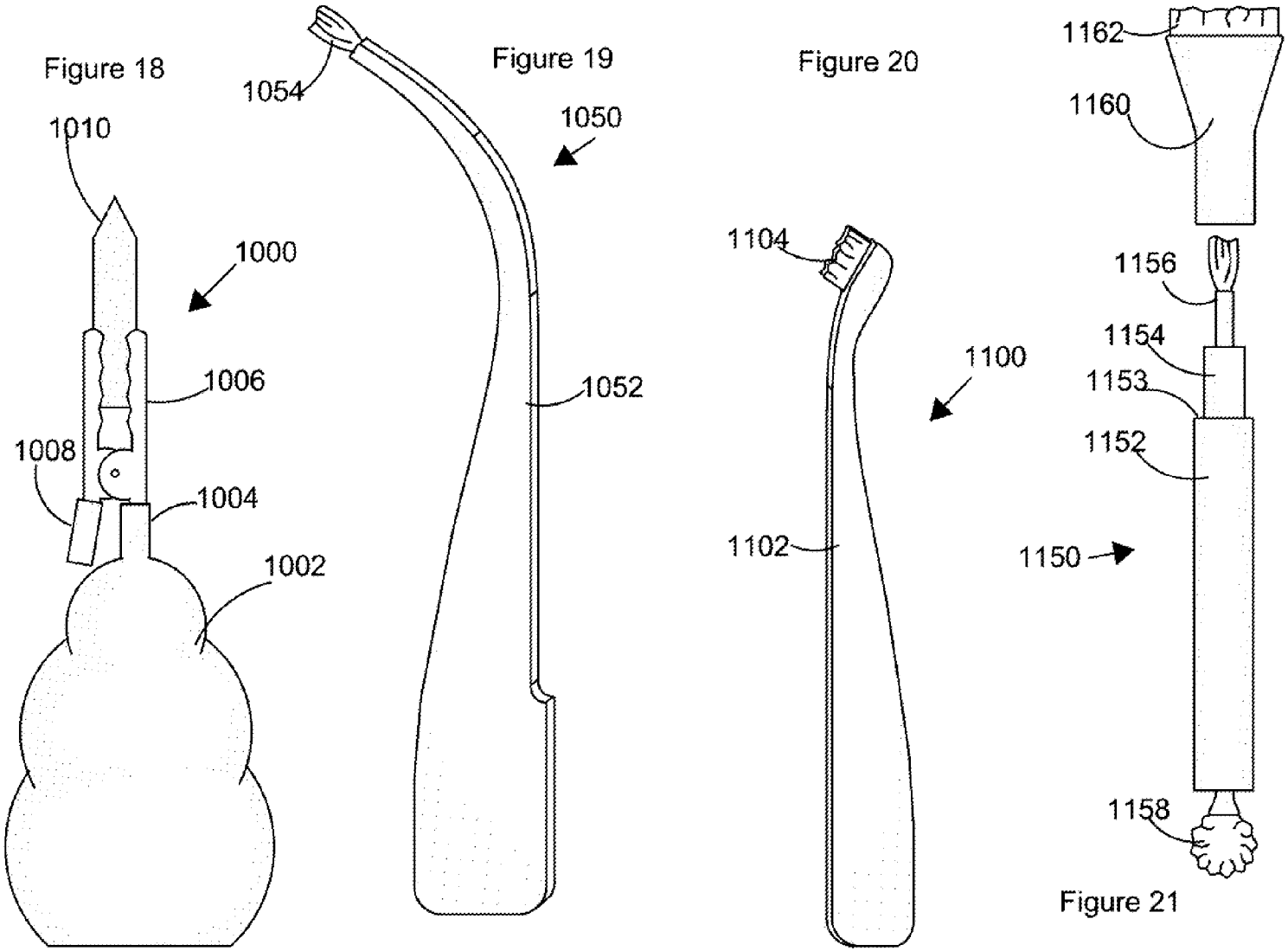
FIG. 18 is a side view of a undulating oval handle having a clip member to retain the marking element enabling removability, in accordance with the invention.
FIG. 19 is a side perspective view of a curved handle having a small depth, in accordance with the invention.
FIG. 20 is a side view of a curved handle having a short neck, in accordance with the invention.
FIG. 21 is a side illustration of a handle having dual marking elements and a cap having a third marking element, in accordance with the invention.

In FIG. 18 the handle 1002 is an undulating oval with a flat base to enable the illustration unit 1000 to sit upright. The connector 1004 of the handle 1002 is configured to receive a clip 1006 having a tab 1008 that enables the clip 1006 to be opened. The clip 1006 is any design that places the jaws of the clip 1006 adjacent to one another when at rest. The clip 1006 can be maintained in its at rest position by springs or clips and various designs will be evident to those skilled in the art. When open, the clip 1006 releases the marking element 1010, enabling it to be replaced.

The handles of FIGS. 19 and 20 are single piece units 1050 and 1100 having a curve leading to the marking element 1054 and 1104 respectively. The handle 1052 curves away from the user while the handle 1102 curves slightly toward the user. The selection of curves with these, as with all angles herein, is dependent upon the position on the user's body and hand when in use. Although the units illustrated herein have a narrow depth, this should not be a restriction as the depth can vary depending up manufacturing choice.

The illustration unit 1150 of FIG. 21 has a solid handle 1152 with a first marking element 1158 at one end and a second marking element 1156 at the opposing end. Between the handle 1152 and the second marking unit 1156 is a connector 1154 having a diameter reduced from the diameter of the handle 1152. This reduction forms a shelf 1153. A cap 1160 is dimensioned to fit over the connector 1154 and second marking element 1156 to rest on the shelf 1153. Preferably the dimensions between the cap 1160 and the connector 1154 form a friction fit to maintain the cap 1160 in place. Alternatively, any applicable means to have the cap snap on and off, can be used. The top of the cap 1160 can contain a third marking element 1162 if desired or simply be used to protect the second marking element 1156.

Figure 22:
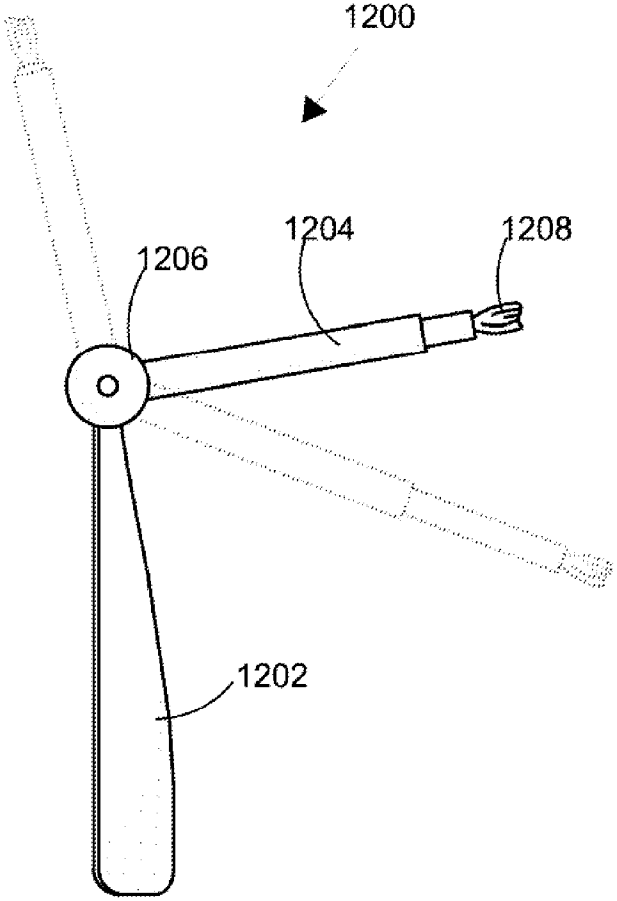
FIG. 22 is a side view of a rotatable illustration unit in accordance with the invention.

The illustration unit 1200 as illustrated in FIG. 22 has a rotation element 1206 between the handle 1202 and the connector 1204. that holds the marking element 1208. The rotation element 1206, which can be similar to a compass for example, and can be held in the selected position through friction or through mechanical means. The rotation permits easy positioning of the marking element 1208 while in use.

Figure 23:
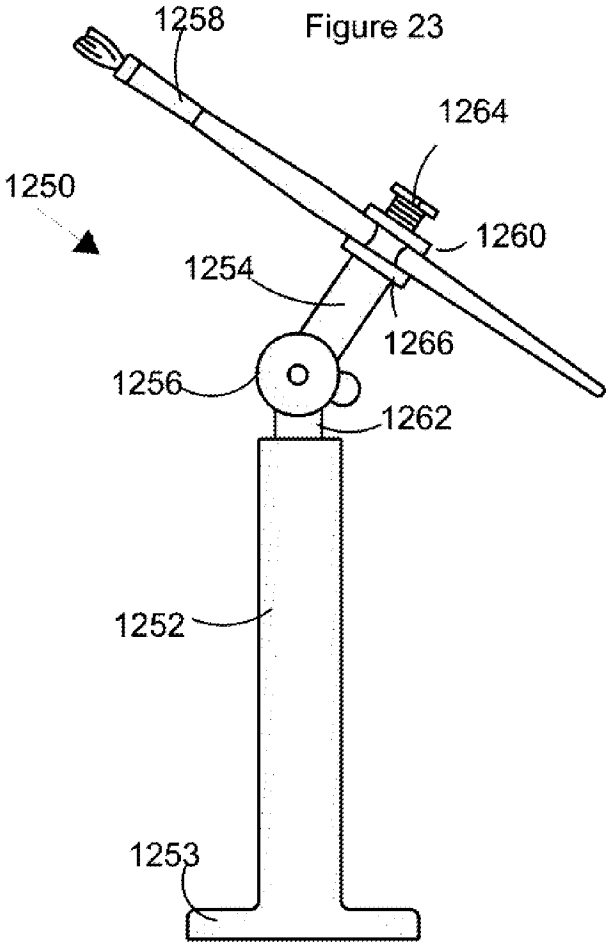
FIG. 23 is a side view of a rotatable and adjustable illustration unit in accordance with the invention.

The rotatable illustration unit 1250 shown in FIG. 23 provides multiple levels of adjustment. The handle 1252 preferably has a base 1253 that can be integral with the handle 1252, removable or adhered as a separate piece. A removable base 1253 provides the advantage that a person does not need to hold the additional weight during use. The handle 1252 is connected to the rotation element 1256 by a small spacer 1262 that prevents the rotation element 1256 from contacting the handle 1252. The connector 1254 is rotatably affixed to the rotation element 1256 and is maintained in the selected location through friction or locking device.

On the opposing end of the connector 1254 from the rotation element 1256 is a marking element grip 1260. The marking element grip 1260 consists of a receiving area 1266 and a securing element 1264. The receiving area 1266 is preferably of a sufficient diameter to accept a number of marking elements 1258 that are held in place through the securing element 1264.

The illustration unit 1250 provides two means within which to customize the device. The rotation element 1256 enables the angle to be selected while the grip 1260 controls the distance between the handle 1252 and the receiving surface.

Figure 24:
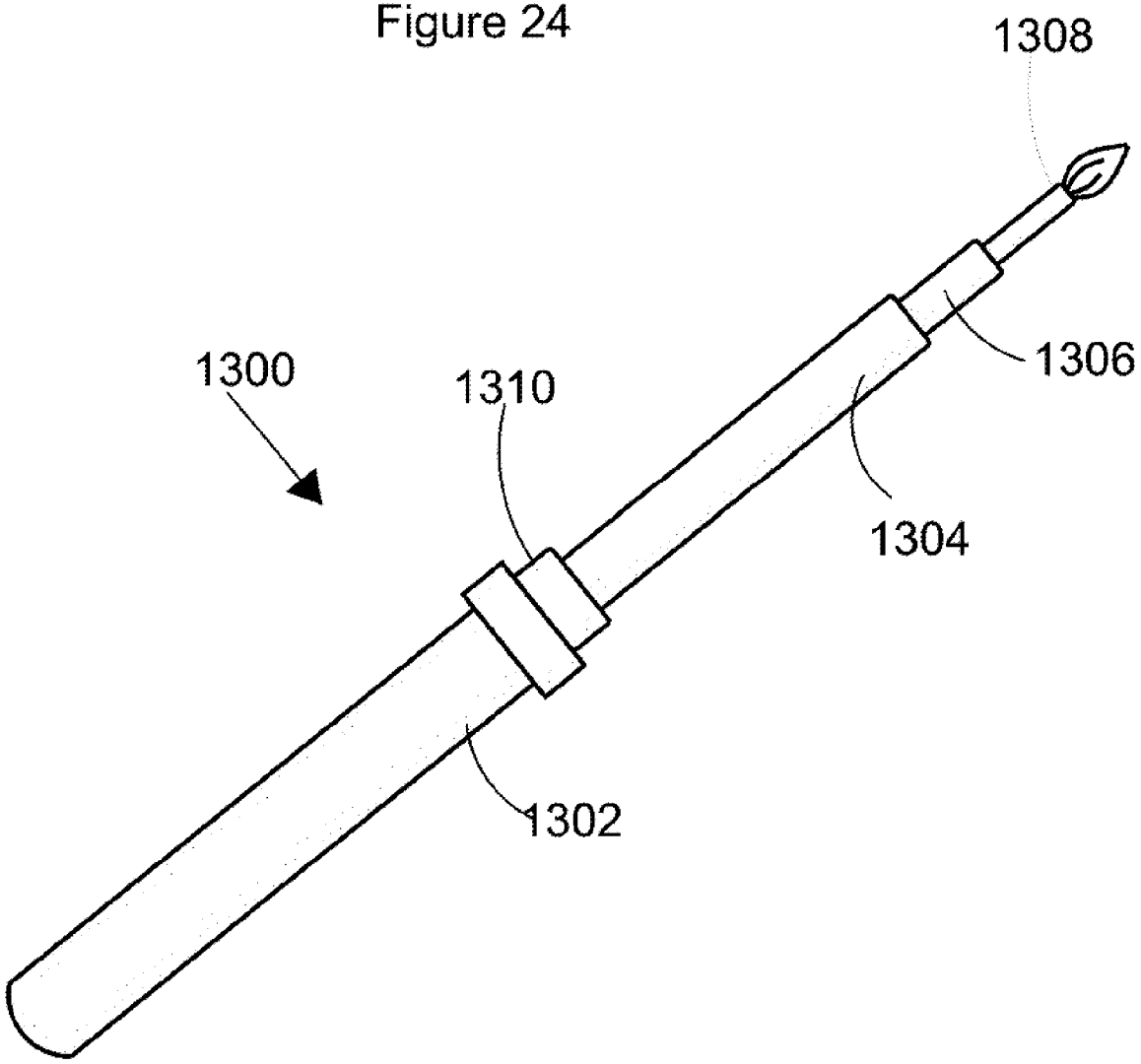
FIG. 24 is a side view of a telescoping illustration unit in accordance with the invention.

The illustration unit 1300 of FIG. 24 provides the capability of telescoping to provide the ability to access a surface from a distance. The handle 1302 contains a first connector 1304 that is dimensioned to fit within the handle 1302. The handle 1302 is preferably made from a soft material, with optional grip indents, having a larger diameter than with standard pointers. A second connector 1306 is dimensioned to fit within the first connector 1304 and the marking element 1308 can, if desired, fit within the second connector 1306. A twist lock 1310 is illustrated securing the extension of the first connector 1304 with friction maintaining the second connector 1306 in place. Other means for maintaining the connectors 1304 and 1306 in place are known in the art and can include buttons, springs, tabs, etc.

Figure 39:
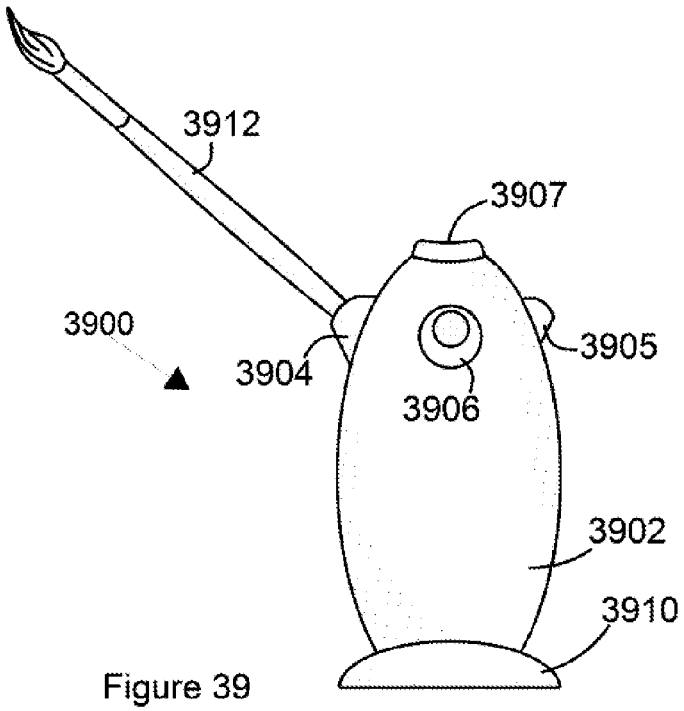
FIG. 39 is a side view of a multi-connector brush.

In FIG. 39, the illustration unit 3900 has an oval body 3902 having a base 3910 at one end and a series of connectors 3904, 3905, 3906, 3907 at the opposing end. Each connector 3904, 3905, 3906, 3907 is of a different size to accommodate marking elements 3912 of different sizes on a single body 3902. In this illustration the removable marking element 3912 has been placed into a connector 3904. If the marking element 3912 were larger or smaller, it would be placed into a different connector 3905, 3906, 3907 that correlated to its size.

Figure 40:
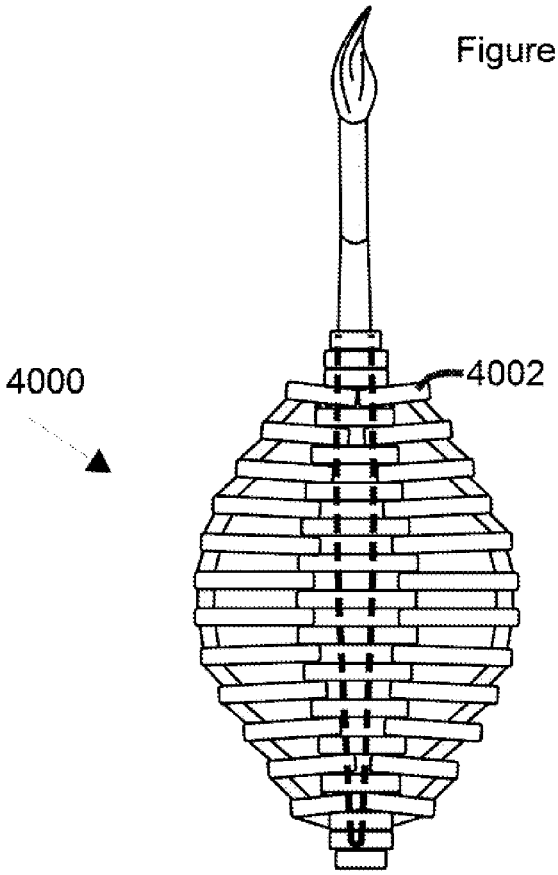
FIG. 40 is a side view of an open-bodied brush.

In FIG. 40, the handle 4002 of the illustration unit 4000 is made from a open woven material that enables air to pass through, and the hand to breathe. In addition, it makes the handle 4002 very light, thus providing a large grip without adding weight that would make it difficult to lift.

Figure 41:
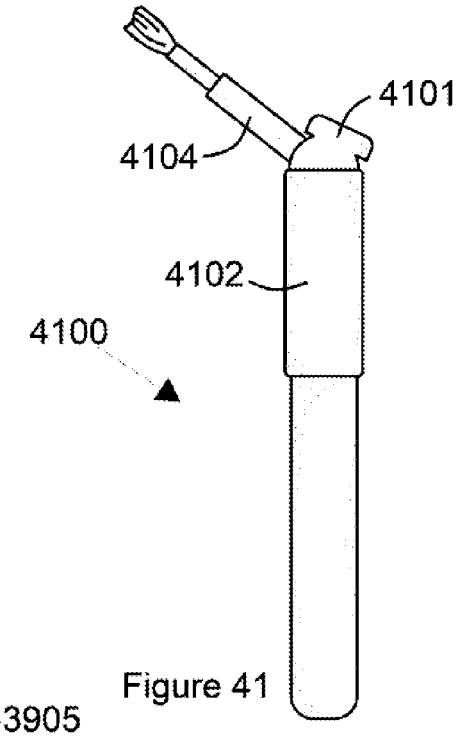
FIG. 41 is a side view of an elongated brush with finger rest.

FIG. 41, between the handle 4102 of illustration unit 4100 and the connector 4104 is a finger rest 4101 to be used with the index finger or thumb depending upon gripping style. The finger rest 4101 is preferably made of a soft, spongy material such as rubber, spandex or silicone, but may be made of hard materials as well. The finger rest 4101 may have additional decorative elements, such as being designed like the head of an animal, while retaining its utility.

It should be noted that the connector 4104 in this embodiment, as well as other embodiments, can be manufactured from a material that will stretch to accommodate a range of marking unit diameters.

Figure 42:
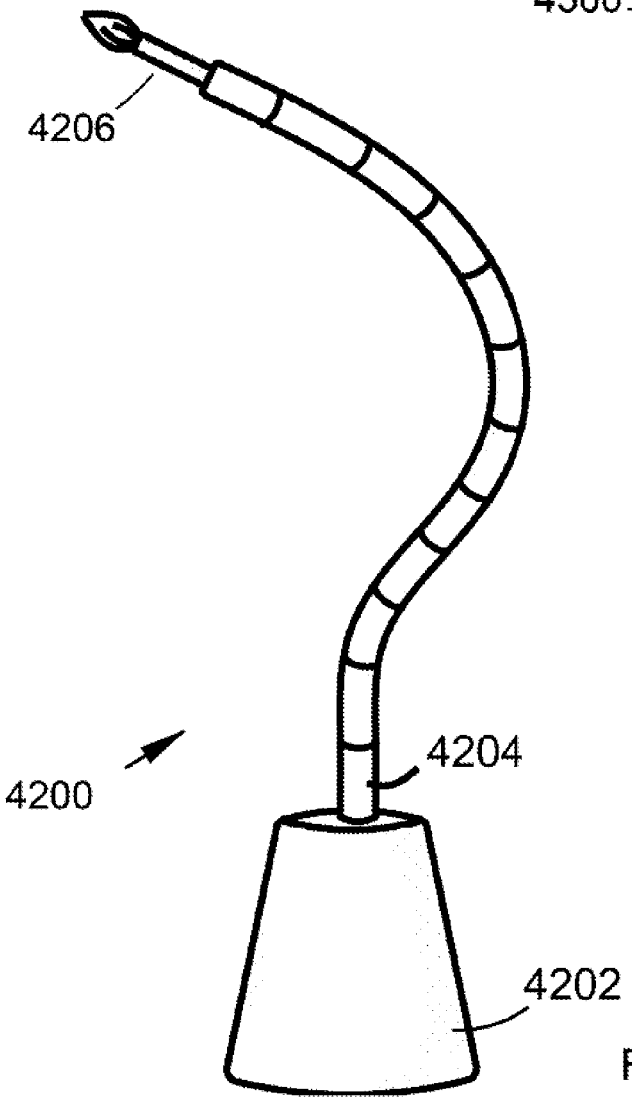
FIG. 42 is a side view of a brush with an elongated articulated connector.

The illustration unit 4200 of FIG. 42 depicts a combined body and handle 4202 with a wide base enabling the body 4202 to stand upright without assistance. The long flexible connector 4204 between the body 4202 and the marking element 4206 is fully articulated shaft that is easily adjustable yet stiff enough to hold its form during painting. The long connector 4204 provides a nearly infinite range of angles to fit any user.

Figure 43:
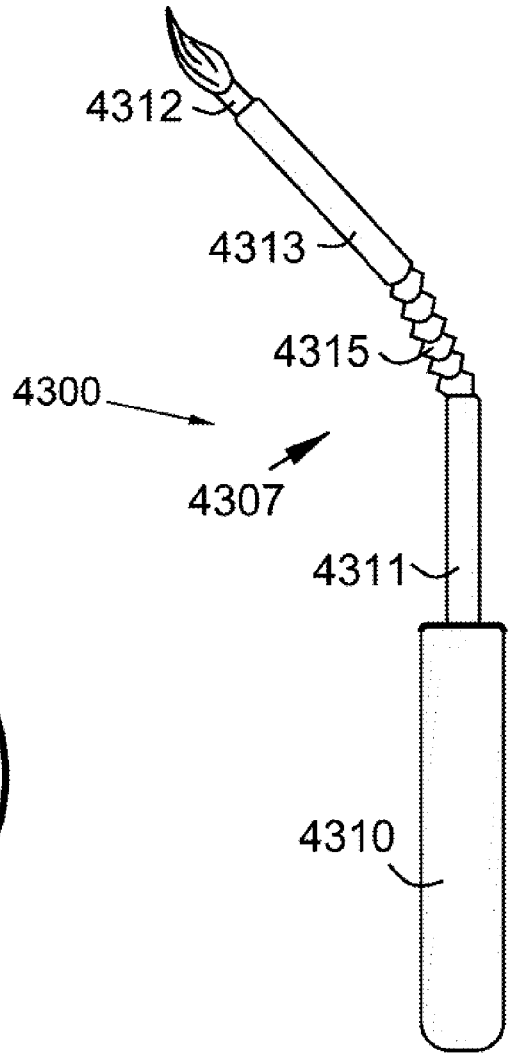
FIG. 43 is a side view of a brush with a partially articulated connector.

FIG. 43 depicts an alternative articulated connector 4307 on illustration unit 4300. The connector 4307 is made up of a first shaft 4311 connected to the body 4310, a second shaft 4313 that accommodates the marking element 4312 and an articulated section 4315 connecting the first shaft 4311 and second shaft 4313. The articulated section 4315 acts similar to a flexible drinking straw, enabling the articulated connector 4307 to point in a wide range of directions, to accommodate the user.

Figure 44:
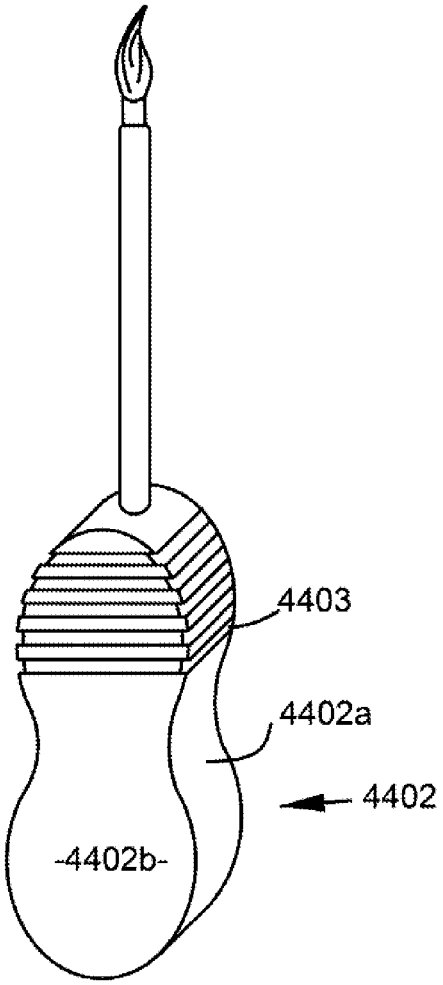
FIG. 44 is a side view of a rounded body with flat sides.

In FIG. 44 the body 4402 of the illustration unit 4400 is made from an easy to grip soft rubber that has a rounded side 4402*a* and a flattened side 4402*b* so that the body 4402 will not roll when set down on a surface. The body 4402 also has a series of grooves 4403 that aid with grippability.

Figures 37, 38:
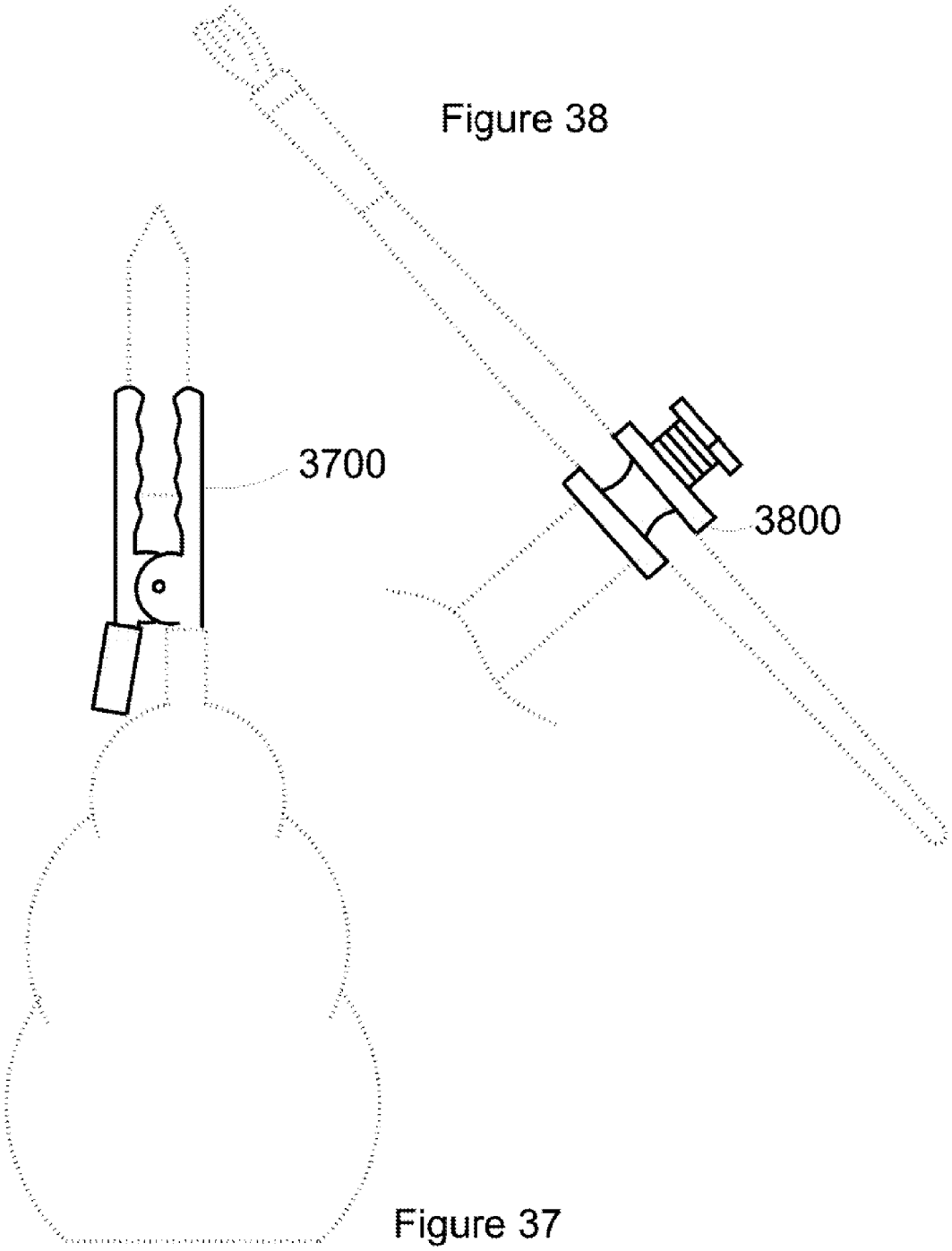
FIG. 37 is a side view of a clip connector.
FIG. 38 is a side view of a clamp connector.
Figure 45:
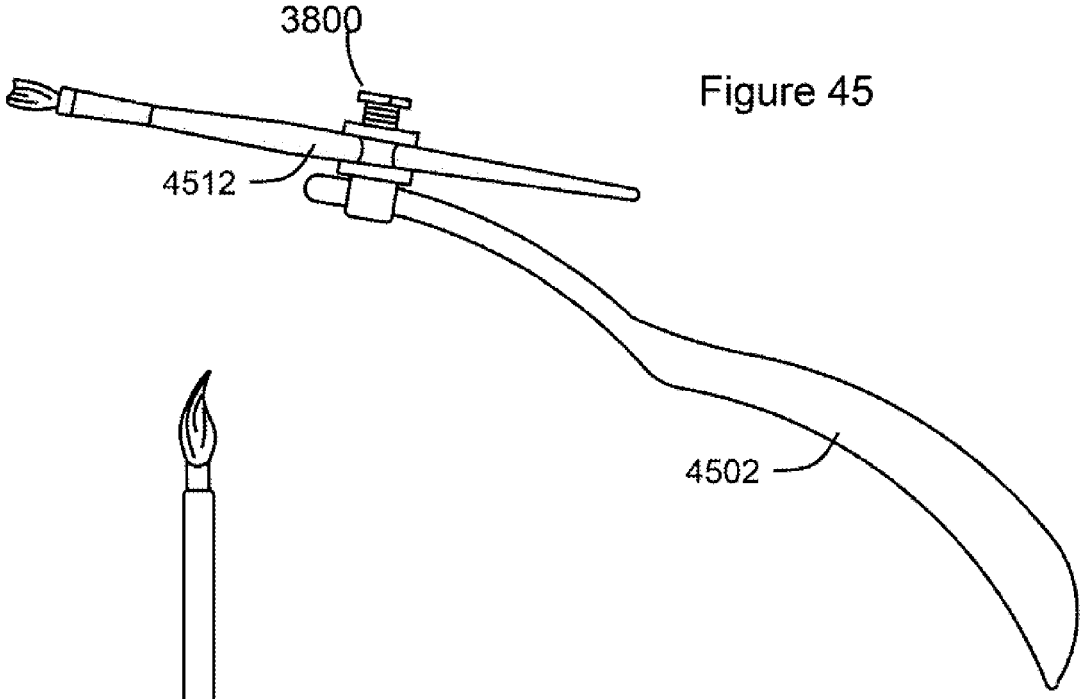
FIG. 45 is a side view of an elongated body.

FIG. 45 illustrates an illustration unit 4500 with an elongated body 4502 with the adjustable clamp 3800 as illustrated and described in FIG. 38. The elongated body 4502 is at an angle of less than 45 degrees to the marking element 4512, such that when held there is a greater reach, and the marking element 4512 "points to" the medium.

Figure 49:
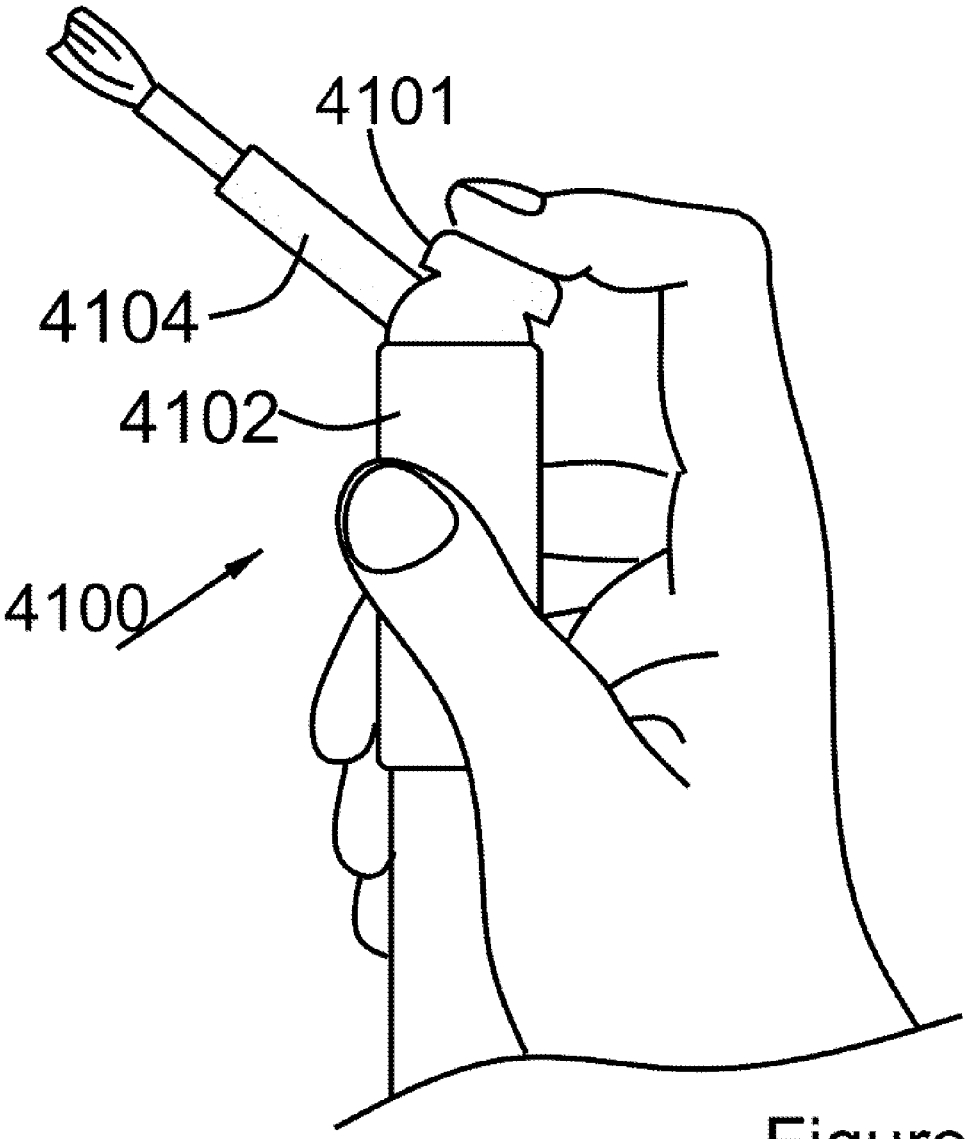
FIG. 49 is a side view of an elongated body with finger rest being gripped by a hand.

FIG. 46 shows a rounded body 4602 brush being held primarily with the finger tips, with the base of the rounded body 4602 secured against the palm of the hand. Alternatively, the same rounded body 4602 is shown in FIG. 47 held with the body against the palm, the fingers wrapped around the body 4602, and the index finger 4712 secured against the connector 4707. The body 4602 is preferably barrel shaped, that is, having a flat top and bottom and curved sides that make it bulge in the middle. FIG. 48 shows an elongated body 4802 with the body 4802 in the palm, with the fingers wrapped around the body 4802 and the outstretched index finger 4812 secured against the body 4802. In FIG. 49, the user is show gripping the illustration unit of FIG. 41. In the embodiment of FIG. 48, the handle or body 4802 is a solid or hollow cylinder having diameter that is preferably at least about ¾ of an inch, an average adult.

Figure 50:
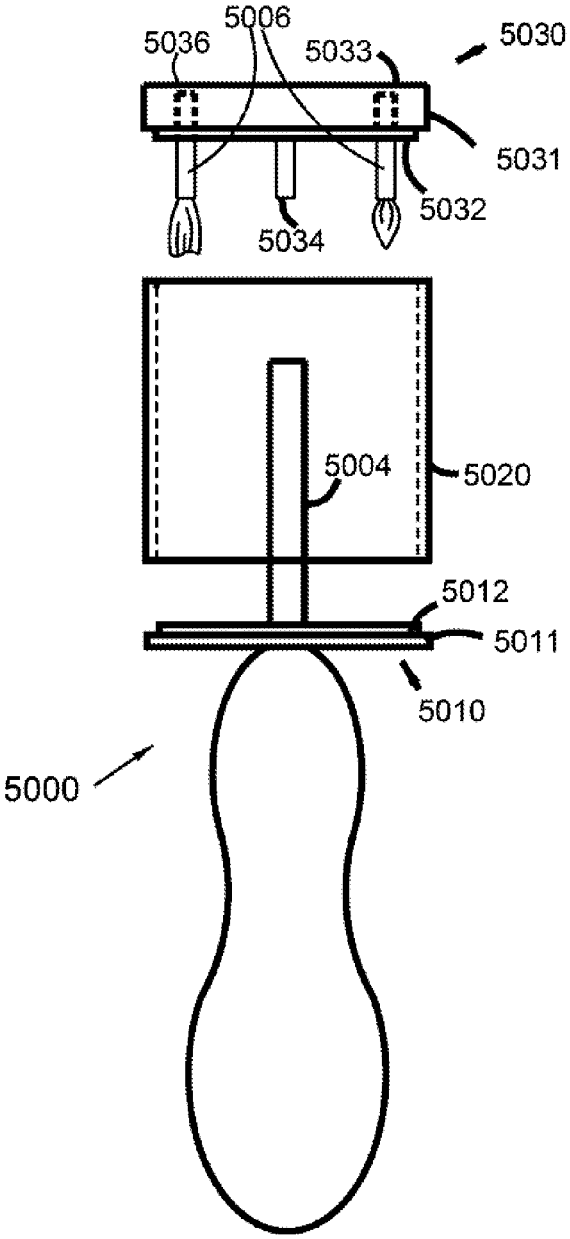
FIG. 50 is a side view of a brush unit with a marking element holder and cover
Figure 51:
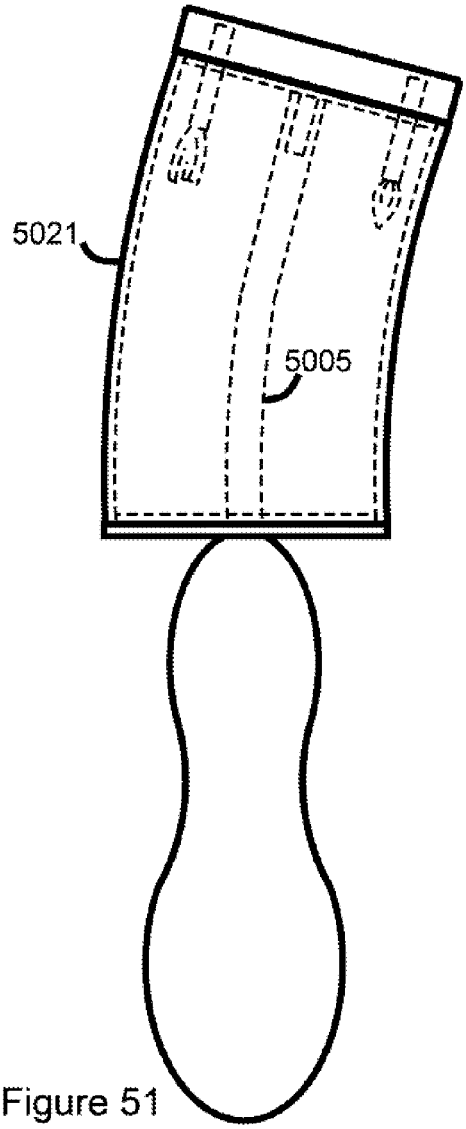
FIG. 51 is a side view of a brush unit with a marking element holder and curved cover

FIGS. 50 and 51 show an alternative embodiment where a cylindrical cover 5020 of the illustration unit 5000 is secured in place by the collar 5010. The cover 5020 is preferably transparent or semi-transparent such that objects within the cover 5020 are visible. The collar 5010 has a collar base 5011 and a raised collar portion 5012 with a smaller diameter than the collar base 5011. The cover 5020 fits over the raised collar portion 5012 and the base of the cover 5020 rests against the collar base 5011 such that the collar 5010 and cover 5020 are secured together 5022 by tension. In this embodiment, the tension is created by the friction fit between the interior diameter of the cover 5020 and the raised collar portion 5012 that has a diameter slightly less that the interior diameter of the cover 5020.

A holder element 5030 has a base 5031 with holes 5036 in which the marking elements 5006 fit. In the preferred embodiment the marking elements 5006 fit snuggly within the holes 5036 such that the marking elements 5006 will remain seated regardless of the orientation of the holder element 5030. A peg 5034 the length and width of a marking element is situated at the center of the holder element 5030 such that the peg 5034 fits within the connector 5004.

Similar to the collar 5010 the holder element 5030 has a holder element base 5031 and a raised holder portion 5032 with a smaller diameter than the holder base 5031. The holder base 5031 is preferably made of a rubbery material that creates enough tension to hold the marking elements in place, but still allows the marking elements to be removed. If a magnetic marking element is used, the body 5033 of the holder base 5031 can be magnetic, to hold the marking elements in place. The cover 5020 fits over the raised holder portion 5032 and the top of the cover 5020 rests against the holder portion base 5031 such that the holder element 5030 and the cover 5020 are secured together 5036 by tension. In an alternative embodiment the seal is such that liquid cannot escape, and the cup formed by the holder element 5030 and the cover 5020 can be used as a cup for holding water or other liquids while painting.

FIG. 51 shows a similar embodiment to FIG. 50, but with a bent cylindrical cover 5021 being used to fit over a bent connector 5005. The covers can be shaped to any number of sizes and shapes to accommodate the connector. In addition, the cover need not be cylindrical, and can be any hollow shape. If, for example, a cube shape was used for the cover, a cube shape collar and cube shaped holder element would be required to accommodate the cover.

Figure 52:
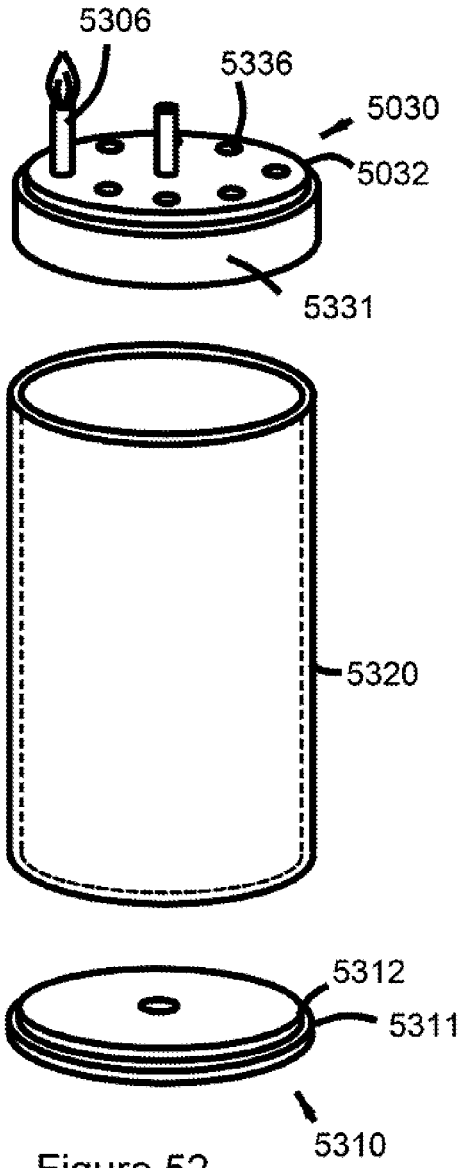
FIG. 52 is an angled view of the expanded cylindrical cover, collar and marking element holder.
Figure 53:
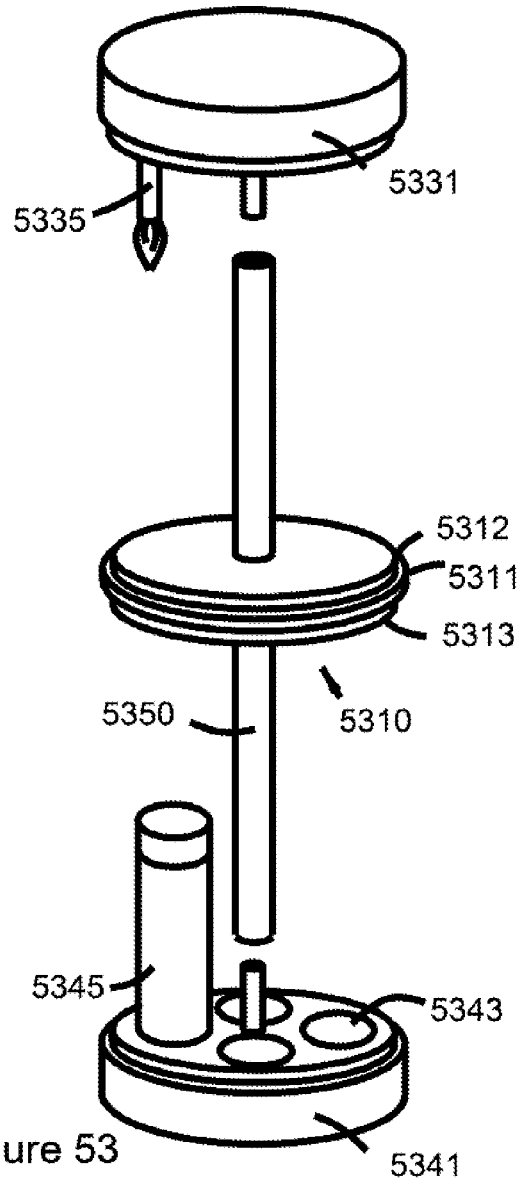
FIG. 53 is an alternative embodiment expanded to show a marking element holder and paint canister element holder.

FIGS. 52 and 53 depict an alternative embodiment of the covered brush. The collar 5310 has a collar base 5311 and a top raised collar portion 5312 with a smaller diameter than the collar base 5311 and a bottom raised portion 5313 with a smaller diameter than the collar base 5311. In this embodiment there are two holder elements. One is a brush holder element 5331 and the other is a paint holder element 5341. The only difference between the holder elements being that the brush holder element 5331 has holes sized to receive marking elements, and the paint holder element has holes 5343 large enough to receive small paint canisters 5345. A narrow body 5350 is used in the example to accommodate the space for the paint canisters 5345 or marking elements 5335. Alternatively, the narrow body 5350 can be absent altogether as the cover 5320 is used as a gripping body, and connects the paint holder element 5341 and the collar 5310 without the need for the narrow body 5350. The benefit of this embodiment is that the user has paints, brushes and a cup all built into the single unit. In such an embodiment, the cover 5320 is preferably permanently secured to the bottom raised portion 5313 and the cover 5020 is secured to the paint holder element 5341 or brush holder element 5331 with screw threads rather than simply tension. The bottom raised portion 5313, the top raised portion 5312 and raised portions of any other elements can alternatively have a screw connection rather than relying solely on tension. This provides a more secure base for gripping, and prevents any elements from accidentally separating. When a screw connection is used, the cover 5020 or other element to be connected will have a receiving screw portion.

Figure 54:
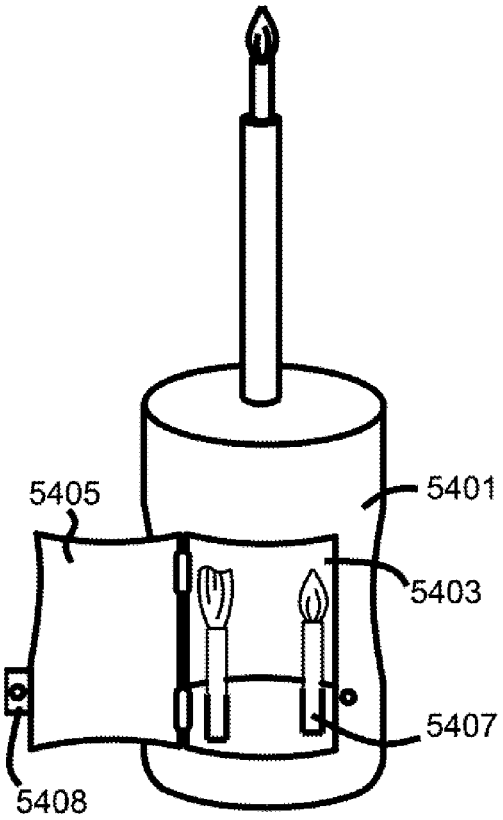
FIG. 54 is an angled view of a hollow-bodied brush with a door.

FIG. 54 depicts a body 5401 that is hollow creating an interior space 5403 in which marking elements 5407 can be stored. In the preferred embodiment the interior diameter is approximately 1" so as to provide space for 6 or more brushes. A door 5405 provides access to the marking interior space 5403 and is kept closed by a securing mechanism 5408 such as a friction lock.

Figure 55:
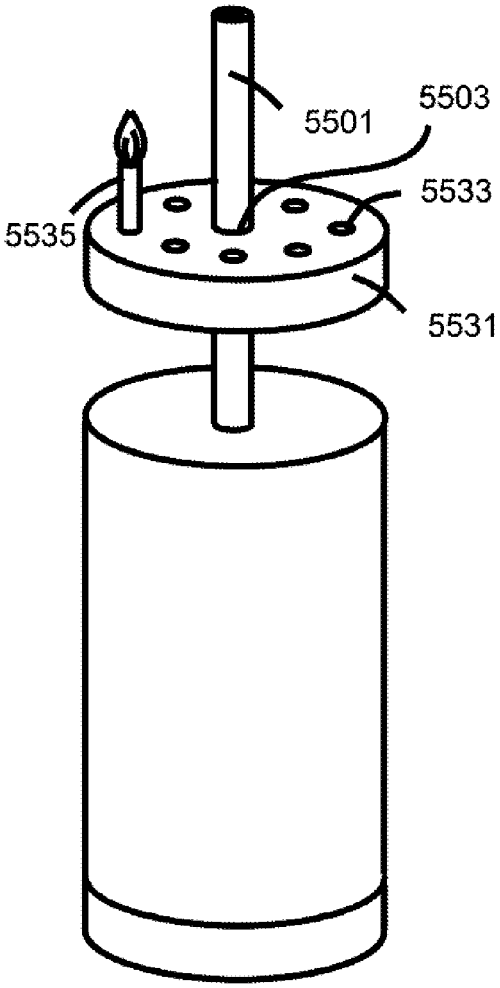
FIG. 55 is an angled view of a brush with an marking element holder

FIG. 55 shows an illustration unit 5500 having a brush holder element 5531 that slides over the connector 5501 via a central hole 5503. The brush, or other marking element, holder 5531 is preferably made from a rubbery material, and includes form-fitting slots 5533 to hold the marking elements 5535. This holder 5531 can be added to any of the previous embodiments. When coupled with the embodiments shown in FIGS. 52 and 53, the holder 5531 can include tension or screw elements to enable it to be used either as a collar on the connector 5501 or as a base to the hollow grip.

Figure 56:
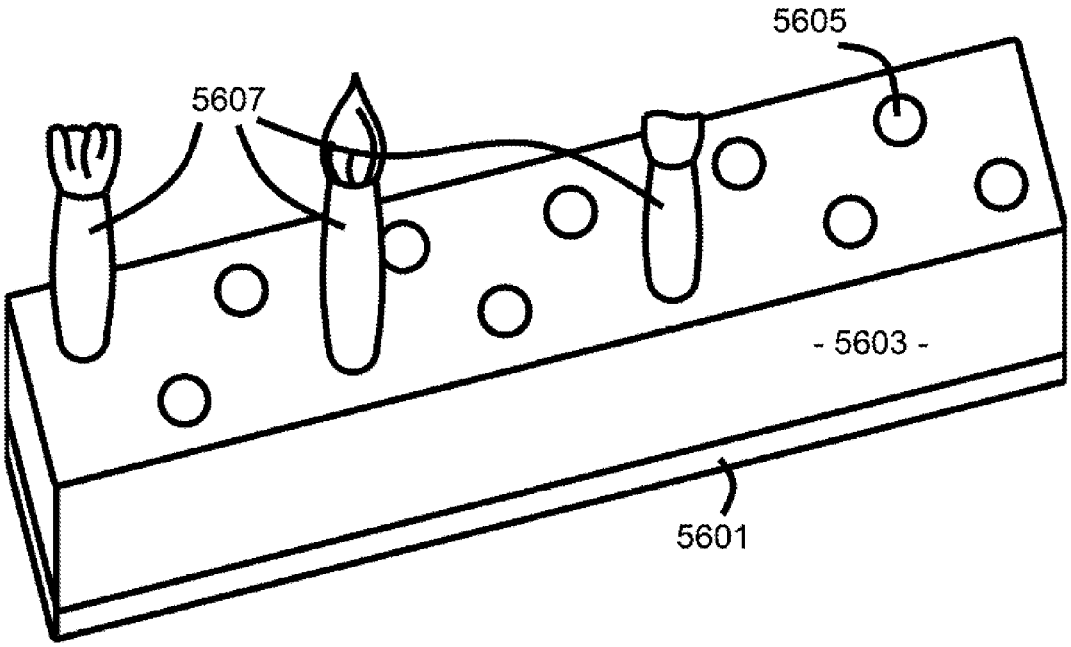
FIG. 56 is a marking element holder separate from a paint brush.

FIG. 56 depicts a marking element holder. The body 5603 is made of a rubbery material to grip the marking elements 5607 when they are placed in the holes 5605. The body 5603 is large enough to accommodate a plurality of holes 5605 such that a wide selection of marking elements 5607 can be stored by the user. An optional magnetic base 5601 keeps the marking elements in place, and allows the body 5603 to be temporarily attached to a metal surface.

Figure 57:
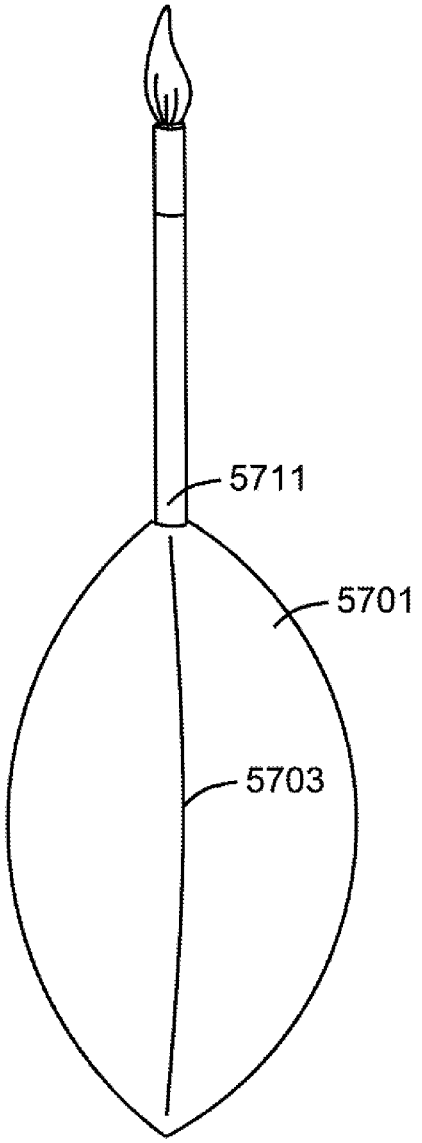
FIG. 57 is a side view of the closed-position body brush.
Figure 58:
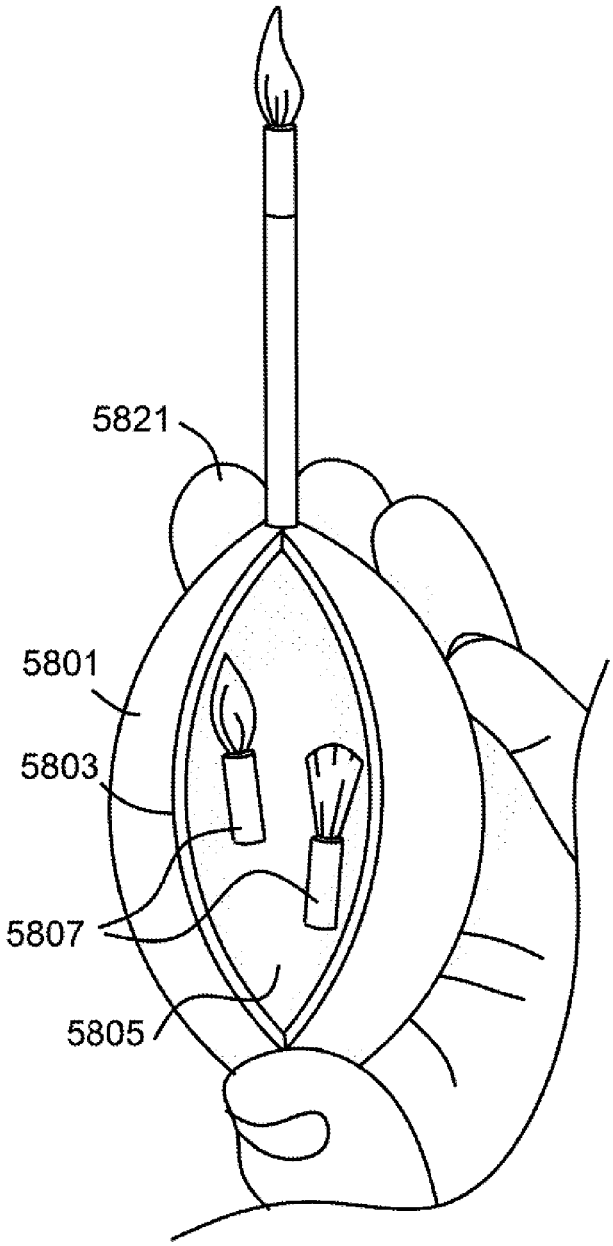
FIG. 58 is a side view of the open-position body brush.

In FIGS. 57 and 58, the uncompressed body 5701 is made from a plastic, rubber or similar flexible material and is a primarily oval shape, resembling the shape of a football (US). An opening slit 5703 runs the length of the body 5701. When the body 5701 is in the uncompressed position the slit 5703 is closed, blocking access to the interior compartment. As seen in FIG. 58, when the body 5801 is compressed the slit 5803 opens, revealing the compartment 5805 inside. The body would typically be compressed by the users hand 5821 applying inward pressure on either side of the body 5801 near the ends of the slit 5803. For ease of applying the inward pressure, the body 5701, 5801 needs to be approximately the size of a user's hand. The inward pressure causes the body 5801 to decrease in length, distorting the body and forcing the sides of the slit 5803 to separate, putting it in the open position and allowing access to the compartment 5805. This compartment 5805 can be used to store a variety of art materials, in particular extra marking elements 5807. This style of squeezable body is most typically found in use with squeeze coin purses. At the top of the body 5701 is the connector 5711 to hold the marking elements. As with other embodiments, the connector 5711 can take a wide variety of shapes and angles.

The illustration units 5900 and 6000 of FIGS. 59 and 60 use a curved base 5902 and 6002 respectively, to retain the marking units 5920, 5922 and 6010. The marking elements in these embodiments are retained through frictional contact. The marking element contacts the interior wall of the base at two points on one side of the interior wall and a single point on an opposing side of the interior wall. This places the ends of the marking element contacting the interior wall at two locations and approximately the midpoint of the marking element having a single contact opposite the contact location of the ends.

In FIG. 59, the illustration unit 5900 can retain two marking elements 5922 and 5920, in opposing ends. The marking units 5920 and 5922 are inserted into a first open end 5912 and second open end 5914 respectively. The arc 5910 must be such that the marking elements 5922 and 5920 can be wedged, and therefore retained, within the hollow core 5904. Although the interior diameter of the hollow core 5904 must be greater than the diameter of the marking element being used, it must not be so great as to require the marking element to be inserted beyond its length without wedging.

In the embodiment of FIG. 59 the body 5902 also can serve as the handle. However in order for the body 5902 to be sufficiently comfortable for use, and to provide the width necessary, the body 5902 can be covered with a foam, rubber, vinyl or other soft material to the desired outer diameter. However, if the body 5902 is quite large, able to hold two large markers for instance, extra padding may not be desired. Also the bottom half of the body 5902 can come down straight and can be elongated to provide a longer handle and reach for the user. As with all embodiments herein the diameter of the body 5902 can vary depending on and use.

In FIG. 60 the illustration unit 6000 has only one end 6006 in which to receive the marking element 6010 with the opposing being inserted into a handle 6004. As with the embodiment in FIG. 59, the width and curve of the body 6002 must be such that the marking element 6010 can be wedged in a non-moving position.

In this as well as other embodiments the connector and/or body can be varied to accommodate marking elements ranging from a small In FIGS. 61 and 62 a cap 6104 is dimensioned to be placed over the body 6102. The marking element 6106 is, in this illustration, a soft material used for smudging pastels or applying paint, however any type of marking element 6106 can be placed on the end of the cap 6104. In other embodiments the cap 6104 can be the base for an eraser, a stamp or stamping material, a second marking element, or other materials to provide the desired result that would replace the marking element 6106. As with all embodiments disclosed here in, the 6104 and associated marking element 6106 can be used with other designs such as illustrated and FIG. 59

Example handle shapes can include:

Fruit, such as bananas, apples, pears, strawberries, etc.

Vegetables, such as potatoes, peppers, jalapenos, etc.

Animals, such as frogs, bears, lions, etc.

Shapes and sizes are chosen based on their attributes rather than purely aesthetic reasons. Certain shapes—which correspond with fruit, vegetables, and animals—fit the hand well, making them ergonomic to use. As such, different fruits, vegetables, and animals may be suited to different projects, such as a strawberry handle for close-up and/or fine detail work. Others such as a banana or curving pepper handle will enable a person to keep their hand in a natural position and does not require them to arch their wrist.

Geometric shapes, such as circles, squares, columns

Example handle materials can include:

Rubbers, in particular silicone rubber

Closed cell foam 26

Open cell foam

Plastics

Woods, including cork and bamboo

Composites

Metal, in particular aluminum which is light and strong

The materials are chosen based on characteristics such as weight, flexibility, their washability and grip comfort.

| FIG. Number | Part Number | Description |
|---|---|---|
| 1 | 100 | unit |
| | 102 | Oval body |
| | 104 | connector |
| | 106 | Marking unit |
| | 110 | base |
| | 112 | Connection point |
| 2 | 150 | Illustration unit |
| | 152 | handle |
| | 154 | base |
| | 156 | Suction cup |
| 3 | 200 | unit |
| | 202 | handle |
| | 204 | base |
| | 206 | connector |
| 4 | 250 | unit |
| | 252 | handle |
| | 254 | head |
| 5 | 500 | unit |
| | 502 | handle |
| | 504 | Receiving areas |
| | 506 | connector |
| | 508 | Marking element |
| | 510 | base |
| 6 | 552 | handle |

-continued

| FIG. Number | Part Number | Description |
|---|---|---|
| | 554 | connector |
| | 556 | Marking element |
| | 558 | base |
| | 560 | collar |
| 7 | 600 | unit |
| | 602 | handle |
| | 604 | connector |
| | 606 | Marking element |
| | 608 | Marking element |
| 8 | 650 | Unit |
| | 652 | handle |
| | 654 | Marking element |
| | 656 | Marking element |
| 9 | 700 | Unit |
| | 702 | handle |
| | 704 | sleeve |
| | 706 | connector |
| | 708 | connector |
| | 710 | Marking element |
| | 712 | Marking element |
| 10 | 750 | unit |
| | 752 | handle |
| | 754 | connector |
| | 756 | Marking element |
| | 758 | collar |
| 11 | 800 | unit |
| | 802 | handle |
| | 804 | Marking element |
| | 806 | Support base |
| 12 | 850 | unit |
| | 852 | spring |
| | 854 | handle |
| | 856 | body |
| | 858 | connector |
| | 860 | Marking element |
| 13 | 900 | unit |
| | 902 | handle |
| | 904 | connector |
| | 906 | base |
| | 908 | Marking unit |
| 14 | 950 | unit |
| | 952 | body |
| | 953 | Decorative cover |
| | 954 | sleeve |
| | 956 | Feeder tube |
| | 958 | brush |
| 15 | 960 | unit |
| | 962 | body |
| | 963 | Body top |
| | 964 | sleeve |
| | 966 | Feeder tube |
| | 968 | brush |
| 16 | 970 | unit |
| | 972 | body |
| | 973 | cap |
| | 974 | sleeve |
| | 976 | Feeder tube |
| | 977 | Decorative element |
| | 978 | brush |
| 17 | 980 | unit |
| | 982 | body |
| | 986 | Feeder tube |
| | 988 | brush |
| 18 | 1000 | unit |
| | 1002 | body |
| | 1004 | connector |
| | 1006 | clip |
| | 1008 | tab |
| | 1010 | Marking element |
| 19 | 1050 | unit |
| | 1052 | handle |
| | 1054 | Marking element |
| 20 | 1100 | unit |
| | 1102 | handle |
| | 1104 | Marking element |
| 21 | 1150 | unit |

-continued

| FIG. Number | Part Number | Description |
|---|---|---|
| | 1152 | handle |
| | 1153 | shelf |
| | 1154 | connector |
| | 1156 | Second marking unit |
| | 1158 | First marking element |
| | 1160 | cap |
| | 1162 | Third marking unit |
| 22 | 1200 | Illustration unit |
| | 1202 | handle |
| | 1204 | connector |
| | 1206 | Rotation element |
| | 1208 | Marking element |
| 23 | 1250 | Illustration unit |
| | 1252 | handle |
| | 1253 | base |
| | 1254 | connector |
| | 1256 | Rotational element |
| | 1258 | Marking element |
| | 1260 | Marking element grip |
| | 1262 | spacer |
| | 1264 | Securing element |
| | 1266 | Receiving area |
| 24 | 1300 | Illustration unit |
| | 1302 | 1302 |
| | 1304 | First connector |
| | 1306 | Second connector |
| | 1308 | Marking element |
| | 1310 | Twist lock |
| 25 | 2500 | Suction cup |
| | 2550 | Flat surface |
| 26 | 2500 | Suction cut |
| 27 | 2700 | Flat base |
| | 2550 | Flat surface |
| 28 | 2800 | Weighted base |
| | 2550 | Flat surface |
| 29 | 2900 | body |
| 30 | 3000 | body |
| 31 | 3100 | body |
| 32 | 3200 | collar |
| 33 | 3200 | collar |
| | 3350 | Flat surface |
| 34 | 3400 | Hollow tube connector |
| | 3402 | Marking element |
| | 3404 | Magnetic base |
| 35 | 3500 | Screw connector |
| | 3502 | Marking element |
| 36 | 3600 | Hollow tube connector |
| | 3601 | Tension ring |
| | 3602 | Marking element |
| 37 | 3700 | Alligator clip |
| 38 | 3800 | Adjustable clamp |
| 39 | 3900 | Illustration unit |
| | 3902 | Oval body |
| | 3904 | connector |
| | 3905 | connector |
| | 3906 | connector |
| | 3907 | connector |
| | 3910 | base |
| | 3912 | Marking element |
| 40 | 4000 | Illustration unit |
| | 4002 | handle |
| 41 | 4100 | Illustration unit |
| | 4101 | Finger rest |
| | 4102 | handle |
| | 4104 | connector |
| 42 | 4200 | Illustration unit |
| | 4202 | Body/handle combination |
| | 4204 | Flexible connector |
| | 4206 | Marking unit |
| 43 | 4300 | Illustration unit |
| | 4307 | Articulated connector |
| | 4310 | body |
| | 4311 | First shaft |
| | 4312 | Marking unit |
| | 4313 | Second shaft |
| | 4315 | Articulated section |

-continued

| FIG. Number | Part Number | Description |
|---|---|---|
| 44 | 4400 | Illustration unit |
| | 4402 | body |
| | 4402a | Curved side |
| | 4402b | flattened side |
| | 4403 | grooves |
| 45 | 4500 | Illustration ounit |
| | 4502 | Elongated body |
| | 4512 | Illustration unit |
| | 3800 | Adjustable clamp |
| 46 | 4602 | body |
| 47 | 4602 | body |
| | 4707 | connector |
| | 4712 | Index finger |
| 48 | 4802 | body |
| | 4812 | Index finger |
| 49 | 4100 | Illustration unit |
| | 4101 | Finger rest |
| | 4102 | handle |
| | 4104 | connector |
| 50 | 5000 | Illustration unit |
| | 5004 | connector |
| | 5006 | Marking elements |
| | 5010 | collar |
| | 5011 | Collar base |
| | 5012 | Raised collar portion |
| | 5020 | Cylindrical cover |
| | 5022 | closed |
| | 5030 | Holder element |
| | 5031 | Holder element base |
| | 5032 | Raised holder portion |
| | 5033 | Holder element body |
| | 5034 | peg |
| 51 | 5005 | bent connector |
| | 5021 | Bent cylinder |
| | 5036 | holes |
| 52 & 53 | 5306 | |
| | 5310 | collar |
| | 5311 | Collar base |
| | 5312 | Raised collar portion |
| | 5313 | Bottom raised portion |
| | 5320 | cover |
| | 5331 | Brush holder |
| | 5335 | Marking element |
| | 5341 | Paint holder element |
| | 5343 | holes |
| | 5345 | Paint canisters |
| | 5350 | Narrow body |
| 54 | 5401 | body |
| | 5403 | Interior space |
| | 5407 | Marking elements |
| | 5405 | door |
| | 5408 | Securing mechanism |
| 55 | 5500 | Illustration unit |
| | 5501 | connector |
| | 5503 | Central hole |
| | 5531 | holder |
| | 5533 | slots |
| | 5535 | Marking elements |
| 56 | 5601 | base |
| | 5603 | body |
| | 5605 | holes |
| | 5607 | Marking elements |
| 57 | 5701 | body |
| | 5703 | Opening slit |
| | 5711 | connector |
| 58 | 5801 | body |
| | 5803 | slit |
| | 5805 | compartment |
| | 5807 | Marking elements |
| | 5821 | User's hand |
| 59 | 5900 | Illustration unit |
| | 5902 | body |
| | 5904 | Interior |
| | 5910 | arc |
| | 5912 | First open end |
| | 5914 | Second open end |

-continued

| FIG. Number | Part Number | Description |
|---|---|---|
| | 5920 | Marking element |
| | 5922 | Marking element |
| 60 | 6000 | Illustration unit |
| | 6002 | body |
| | 6004 | handle |
| | 6006 | Open end |
| | 6010 | Marking element |
| 61 | 6100 | Illustration unit |
| | 6102 | body |
| | 6104 | cap |
| | 6106 | Marking element |
| 62 | 6104 | cap |
| | 6106 | Marking element |
| 63 | 6302 | Index finger |
| | 6304 | Middle finger |
| | 6306 | Ring finger |
| | 6308 | pinky |
| | 6310 | thumb |
| | 6312 | thenar |
| | 6314 | Distal plamar |
| | 6316 | Proximal plamar |

What is claimed is:

1. An illustration unit to enable a user to contact a surface approximately parallel to said user's body, said illustration unit comprising:

a) a handle, said handle being a hollow arcuate member with an interior surface and an exterior surface, said interior surface being dimensioned to receive said marking element contacting a first area of said interior surface at two points of contact and contacting a second area, opposite said first area, of said interior surface at one point of contact, said one point of contact located between said two points of contact, said handle having a diameter sufficient to prevent a user's pinky, ring and middle fingers from contacting a user's proximal or distal palmar, b) at least two receiving areas a first of said at least two receiving areas being dimensioned the same or differently than another of said at least two receiving areas, and c) at least one releasable marking element.

2. The illustration unit of claim 1 wherein said handle is a pliable, non-slip material.

3. The illustration unit claim 1 wherein said user's pinky, ring and middle fingers come proximate to or in contact with the thenar.

4. The illustration unit of claim 1 wherein said handle is configured to enable said user to contact said surface with said at least one marking element.

5. The illustration unit of claim 1, wherein said handle is cylindrical and has a diameter of at least ¾ inch.

6. The illustration unit of claim 1 wherein a user's pinky, ring and middle fingers wrap around said handle in a first direction and said thumb wraps around said handle in an opposing direction to bring said handle in contact with said user's distal palmar and proximal palmar.

7. An dexterity enhancing illustration unit comprising:

a handle, said handle being a hollow arcuate member with an interior surface and an exterior surface, said interior surface being dimensioned to receive a marking element, said marking element contacting a first area of said interior surface at two points of contact and contacting a second area, opposite said first area, of said interior surface at one point of contact, said one point of contact located between said two points of contact, said handle having a diameter sufficient to enable said user's pinky, ring and middle fingers come proximate to or in contact with the thenar and prevent a user's pinky, ring and middle fingers from contacting a user's proximal or distal palmar and having a diameter between about 0.5 inches and about 3 inches, at least one receiving area, said at least one receiving area being dimensioned to receive a connector or a marking element and at least one marking element wherein said illustration unit is configured to enable said user to contact a surface with said at least one marking element.

8. The illustration unit of claim 7 wherein a user's pinky, ring and middle fingers wrap around said handle in a first direction and said thumb wraps around said handle in an opposing direction to bring said handle in contact with said user's distal palmar and proximal palmar.

* * * * *